US006630414B1

(12) United States Patent
Matsumoto

(10) Patent No.: US 6,630,414 B1
(45) Date of Patent: Oct. 7, 2003

(54) THREE-DIMENSIONAL NET, AND COMPOSITE STRUCTURAL MATERIAL USING THE SAME

(75) Inventor: Koichi Matsumoto, Fukui (JP)

(73) Assignee: Asahi Doken Kabushiki Kaisha, Fukui (JP)

( * ) Notice: Subject to any disclaimer, the term of this patent is extended or adjusted under 35 U.S.C. 154(b) by 0 days.

(21) Appl. No.: 09/581,391

(22) PCT Filed: Oct. 14, 1999

(86) PCT No.: PCT/JP99/05684

§ 371 (c)(1),
(2), (4) Date: Jun. 22, 2000

(87) PCT Pub. No.: WO00/22215

PCT Pub. Date: Apr. 20, 2000

(30) Foreign Application Priority Data

Oct. 14, 1998 (JP) ..... 10-292626

(51) Int. Cl.[7] ..... D04B 21/10; D04B 21/20; B32B 5/18; B32B 5/26; B32B 3/12; B32B 3/26

(52) U.S. Cl. ..... 442/1; 442/312; 442/315; 442/318; 442/319; 66/169 R; 66/195; 66/196; 428/114; 428/116; 428/117; 428/118; 428/320.2

(58) Field of Search ..... 442/1, 312, 318, 442/315, 319; 66/169 R, 195, 196; 428/114, 116, 117, 118, 320.2

(56) References Cited

U.S. PATENT DOCUMENTS 5,601,907 A 2/1997 Matsumoto
6,305,875 B1 * 10/2001 Matsumoto ..... 405/16

FOREIGN PATENT DOCUMENTS

EP 774544 A1 * 5/1997 ..... E02D/17/20
EP 808950 A1 * 11/1997 ..... E02D/17/20
JP 5-269899 10/1993
JP 05269899 A * 10/1993 ..... B32B/5/02
JP 8-74158 3/1996
JP 10131008 A * 5/1998 ..... D04B/21/14
JP 10158962 A * 6/1998 ..... D04B/21/14
JP 10259612 A * 9/1998 ..... E02D/17/20
JP 11152663 A * 6/1999 ..... D04B/21/20
JP 2000027057 A * 1/2000 ..... D04B/21/14
JP 2000265345 A * 9/2000 ..... D04B/21/02

* cited by examiner

*Primary Examiner*—Cheryl A. Juska
(74) *Attorney, Agent, or Firm*—Jordan and Hamburg LLP

(57) ABSTRACT

Invention-wise three-dimensional net made by warp knitting has high shape retainability in three-dimensional cords defining three-dimensional mesh spaces, capability of suppressing direction dependency, superiority in structural stability and pressure resistance, capability of retaining a suitable degree of elasticity and formation of three-dimensional cords simply by imparting tension, high void content, and lightweight, which are suitable for various applications. Invention-wise three-dimensional net formed by warp knitting comprises a first mesh web, a second mesh web and connecting yarns 3 connecting the first and second mesh webs 1 and 2, on front and back sides of the net, with a required spacing therebetween; further comprises three-dimensional cords each formed by braids on the first mesh web and the second mesh web 1 and 2 and by the connecting yarns 3 front-to-back-wise passed between the braids 11 and 12 of the first and second mesh webs 1 and 2, said first mesh web 1 having larger mesh openings than those of the second mesh web 2. At least partly in each of said three-dimensional cords 4, said connecting yarns 3 are passed from a single braid 11 on the first mesh web 1 to a plurality of braids 21 on the second mesh web 2 so that said three-dimensional cord 4 has a width of at least one mesh openings 12 on the first mesh web 1.

15 Claims, 20 Drawing Sheets

THREE-DIMENSIONAL NET, AND COMPOSITE STRUCTURAL MATERIAL USING THE SAME

TECHNICAL FIELD

The present invention relates to a three-dimensional net made by warp knitting, particularly a three-dimensional net that is superior in structural stability and shape retainability in three-dimensional cords defining three-dimensional mesh spaces, press-load resistance and elasticity and that can be widely suitably used for various applications, and it also relates to a composite structural material using said net.

BACKGROUND ART

Following three-dimensional net is known as a net formed by double-web warp knitting. First and second webs at least one of which is of mesh construction are connected together by connecting yarns, so as to form three-dimensional cord portions which defining three-dimensional mesh spaces (mesh perforations penetrating the three-dimensional net), thus increasing the thickness and void content.

This three-dimensional net made by warp knitting has a direction dependency due to knitting construction including loop-forming configurations of connecting yarns, which is a drawback inherent in double-web knitted fabrics formed by warp knitting, with the result that the net is liable to collapse or fall in one direction (mainly in the knitting direction). Particularly, the larger the thickness of the net, the more distinct is said drawback.

In the case where the cord portions defining three-dimensional mesh spaces formed by double-web knitting constitute substantially vertical walls with respect to the front and back mesh webs due to double knit, the larger the thickness of the net, the greater the length of the connecting yarns (the height of the cord portions defining the three-dimensional mesh spaces), so that the stability against collapsing or falling is lost. To compensate for this drawback, it is necessary, for example, to increase web-wise dimension of the three-dimensional mesh spaces. That is, a three-dimensional net having an increased thickness necessarily has three-dimensional mesh spaces of increased dimension.

If, however, the three-dimensional mesh spaces is increased in size, the press-load-receiving area per unit area of the net becomes smaller and partialized, because the area for supporting external load is limited onto the three-dimensional cords. Thus, no sufficient pressure-resisting strength is achievable. Moreover, even if the surfaces is covered with sheeting, such as knitted or woven fabric, the regions corresponding to the three-dimensional mesh spaces are recessed, so that the surface presents net-peculiar undulations, which are unsightly and feel unpleasant to the touch. In addition, the pressure-resisting strength differs from place to place.

Therefore, it is far from satisfactory for use as a spacer, shoe insole, cushion material, mat material or the like that is desired to have a large thickness, sufficient elasticity and pressure resistance and to have three-dimensional mesh spaces of reduced size.

Further, in the case where high pressure resistance, high elasticity and high structural stability are required, the net thickness or the three-dimensional mesh space diameter (the distance across) cannot be made so large and the use of the net is limited. That is, it is impossible to provide a net whose mesh openings are large as a whole.

Further, in the case of articles of clothing, such as spacers for clothing, cushion materials or the like where substantial pressure resistance, elasticity and structural stability are required and where the three-dimensional mesh spaces are required to be small, the void content of a conventional three-dimensional net is low and grammage or weight (g) per unit area ($m^2$) increases, a fact which is disadvantageous from the standpoint of use and cost.

Further, in order to allow a three-dimensional net made by warp knitting to be widely used for various applications in mat materials, cushion materials or the like, the applicant of the present invention has previously proposed a net designed to improve pressure resistance and structural stability (for example, (a) Japanese Registered Patent NO. 2762052, (b) JP-A-10131008(JP-A-1988-131008, Japanese Unexamined Patent Publication Hei 10-131008).

In the above, according to a document (a), yarns on the three-dimensional cords defining three-dimensional mesh spaces are alternately inclined right and left to form a truss structure. Meanwhile, according to a document (b), connecting yarns constituting three-dimensional cords defining three-dimensional mesh spaces are passed or extended in X-form to prevent collapsing or falling.

Heretofore, effort has been made to secure, by said techniques, structural stability for three-dimensional nets made by warp knitting. However, in either case, sufficient structural stability cannot be obtained unless a balance between the size of three-dimensional mesh spaces and the length of connecting yarns is achieved. Moreover, there are cases where the three-dimensional structure itself cannot be secured, and the void content lowers while the grammage ($g/m^2$) increases.

For example, in the case of a net of truss construction in the document (a), if the thickness of the net increases, so does the diameter of three-dimensional mesh spaces, so that the strength to support a load in the direction of the thickness of the net is weakened, with the result that the pressure-resisting strength and elastic force in the direction of the thickness of the net are reduced. That is, in order to provide structural stability against collapsing or falling, it is necessary to increase the diameter of three-dimensional mesh spaces the more, the greater the thickness.

Further, in the case of the net of truss construction, the positions of the junctions of braids defining the mesh openings of front and back mesh webs are shifted in the knitting direction, so that a connecting yarn connecting a braid on first mesh web and corresponding braid on second mesh web is inclined rightward and leftward alternately. Thus, in plan view, the braid on the first mesh web crosses the braid on the second mesh web. Therefore, when the net is unfolded to be spread and subjected to a treatment such as heat setting, the distance between stitch forming positions of connecting yarns hung between the braids in the first and second mesh webs differs. The distance between which the connecting yarn are passed and hung become largest when the connecting yarns are passed and hung between junctions of the first and second mesh web, while the distance become smallest at the plan-view-wise crossing point.

On the other hand, since the length of the connecting yarns passed and hung between the front and back braids is basically constant, the connecting yarns are almost linear between said junctions between which the distance is largest, while in said crossing portion where the distance is smallest, the connecting yarns are bent, failing to develop sufficient pressure-resisting strength. Further, since the connecting yarns between said junctions are most greatly inclined, the pressure-resisting strength is lower than when the connecting yarns extend vertically.

Further, in a three-dimensional net of the type in which the front and back braids that are in zigzag form cross each other, there are connecting yarns that are upright with respect to the front and back mesh webs and connecting yarns that are inclined. The effect of these connecting yarns provides two strengths, the pressure-resisting strength and the strength to resist transverse collapsing or falling. If the number of upright connecting yarns is increased in order to increase the pressure-resisting strength, the strength to resist falling decreases. Reversely, if the number of inclined connecting yarns is increased in order to increase the strength to resist collapsing or falling, this results in a decrease in the pressure-resisting strength in the direction normal to the net surface (the direction of the net thickness.) Further, since a complete balance between the pressure-resisting strength in the direction of the net thickness and the strength to resist transverse falling cannot be achieved, stability with respect to pressure-resisting strength is insufficient.

Therefore, although the three-dimensional nets proposed in the documents (a) and (b) are intended to solve the problem of direction dependency countermeasures against collapsing of falling in the knitting direction peculiar to double-web knitted fabrics formed by warp knitting have not necessarily produced a sufficient effect in addition, in use of the proposed nets, problems have sometimes occurred in connection with press-load resistance. For this reason, certain limitations have been imposed on the size of three-dimensional mesh spaces and the length of connecting yarns and their applications and manner of use have been limited.

Accordingly, the present invention is intended to provide a three-dimensional net solving these problems, that is, a three-dimensional net that has the improved shape retainability of three-dimensional cords defining three-dimensional mesh spaces, particularly effective in canceling the direction dependency peculiar to warp knitting, superior in structural stability and pressure resistance, capable of retaining satisfactory elasticity and easily forming three-dimensional cords defining three-dimensional mesh spaces simply by imparting tension, said net having a high void content, being light in weight and easy to handle, these characteristics being utilized to use the net as an industrial material for various clothes, mats, cushions and their intermediate materials or use the net as a vegetation net on the faces of slopes or a protective net, the net being widely suitably used for various other applications, and the invention also provides a composite structural material using said three-dimensional net.

DISCLOSURE OF THE INVENTION

Invention-wise three-dimensional net which is formed by warp knitting and which has a first mesh web, a second mesh web and connecting yarns connecting the first and second mesh webs, on front and back sides of the net, with a required spacing therebetween; comprises three-dimensional cords each formed by braids on the first mesh web and the second mesh web and by the connecting yarns front-to-back-wise passed between the braids of the first and second mesh webs, said first mesh web having larger mesh openings than those of the second mesh web; wherein, at least partly in each of said three-dimensional cords, said connecting yarns are passed from a single braid on the first mesh web to a plurality of braids on the second mesh web so that said three-dimensional cord has a width of at least one mesh openings on the first mesh web.

According to this three-dimensional net, the mesh openings differ in size between the front and back mesh webs, and since one mesh is smaller than the other mesh, the use of the net, even if having the relatively large three-dimensional mesh spaces, with its smaller mesh openings turned frontward results in the front surface having an attractive appearance and a pleasant touch, and particularly in the state in which the net is covered with a sheet, there is no possibility of the unevenness of the net appearing on the outer surface. Further, since a combination of larger and smaller mesh openings provides relatively large three-dimensional mesh spaces, the void content is high, making it possible for the net to have a void content of, e.g., 80% or more, and the net can be made lightweight even if it is thick. Above all, those nets whose void content is 90% or above are further lighter in weight and easy to handle.

Further, since each of said three-dimensional cords defining three-dimensional mesh spaces has, in the whole or part thereof, said connecting yarns extended from a single braid on the side associated with the larger mesh openings to a plurality of braids on the side associated with the smaller mesh openings. Thus, the three-dimensional cord has a width of at least one mesh openings on the side associated with the smaller mesh openings. There are attained satisfactorily retained elasticity, satisfactory structural stability of the three-dimensional cords, suppressed direction dependency peculiars to double-web knitted fabrics made by warp knitting, no possibility of falling, and satisfactorily retained pressure resistance.

Further, since the mesh openings of one of the front and back mesh webs are smaller, it is easy to open and spread the folded net, the planar dimensional stability increases for the net in its entirety, and the three-dimensional shape stability and dimensional stability in the spread state are improved. Therefore, the size of the mesh openings on the front and back sides and of the three-dimensional mesh spaces can be freely selected according to uses.

Particularly, at least partly in each of said three-dimensional cords, said connecting yarns are inclined as front-to-back-wise passed between the first and second webs, so that said each of three-dimensional cords assume a three-dimensional shape having three-dimensional voids therein. The three-dimensional voids preferably are substantially triangular, substantially inverted triangular, substantially trapezoidal, substantially inverted trapezoidal or the like in cross section.

Thereby, the passed and hung portions of the connecting yarns inclined in said three-dimensional cards are inclined mainly to opposite sides as seen particularly from the braids on the side associated with larger mesh openings to perform a prop action. Therefore, the pressure resistance is satisfactory, the shape is hardly lost, the structural stability of the three-dimensional cords is superior, balance is kept, direction dependency peculiar to double-web knitted fabrics made by warp knitting is suppressed, and falling never occurs. Therefore, in the case where forces act substantially perpendicularly to the reticular front and back mesh webs; the three-dimensional net is compressed perpendicularly to the front and back surface, exerting an excellent cushioning property.

Further, in said three-dimensional net, it is preferable that each of said three-dimensional cords has a three-dimensional void defined by the inclined connecting yarns so that said three-dimensional cords form a tunnel structure continuous to be fluid-conductive in the knitting direction and/or in the knitting-width direction.

That is, when the three-dimensional cords thus formed are stretched by being opened or deployed as a three-dimensional net, three-dimensional shapes are formed that are continuous in tunnel form, so that the effect of stabilizing the three-dimensional shapes is high and said structural stability and the effect of preventing falling are further increased. Further, the voids in the three-dimensional cords continuous in tunnel form can be effectively utilized as passages for air, water and the like. For example, when the net is used as a vegetation net for greening or stabilizing the faces of slopes, satisfactory passage of air and water can be ensured since said three-dimensional cords possess tunnel-shaped three-dimensional voids therein even if the three-dimensional mesh spaces are filled with foreign substances, such as soil dressing.

If the net is used as a bedsore preventing mat, a sheet having an air conditioning function for automobiles, inner material or insole for shoes, or the like, sufficient air is supplied all the time not only by the tunnel construction of said three-dimensional voids but also by the high three-dimensional void content provided by the three-dimensional mesh spaces and by a pumping effect provided by the cushioning property of the net; thus, it can be suitably used as a mat material having good gas permeability.

Said three-dimensional net of the present invention may be made such that the braids forming the larger mesh openings in one of the front and back mesh webs are formed by a row or rows of stitches forming one wale or a plurality of wales, while the braids forming the smaller mesh openings in the other mesh web are formed by a row of stitches forming one wale or by rows of stitches forming less wales than in the braids forming the larger mesh openings, said braids being alternately junctioned together with the braids adjoining on opposite sides every required spacing in the knitting direction, thereby assuming a zigzag form, forming polygonal mesh openings.

Thereby, the connecting yarns in said three-dimensional cords are extended from the braids forming larger mesh openings or from junction between said braids to a plurality of the other braids as the connecting yarns are rightwardly and leftwardly inclined, thus forming three-dimensional shapes having three-dimensional voids therein as described above. Furthermore, this ensures satisfactory reliable prop action provided by said connecting yarns, good balance, and pressure-resisting strength and shape retainability further improved as a whole.

Further, said three-dimensional net of the present invention may be made such that the braids forming mesh openings in one of the front and back mesh webs are knitted in marquisette construction using a row of stitches that is a row of chain stitches forming one wale and inlay yarns traverse-wise inserted in said row of stitches, whereby the mesh openings of the mesh webs assume a quadrangular shape, while the braids forming mesh openings in the other mesh web are formed by a row of stitches forming one wale or by rows of stitches forming a plurality of wales, said braids being alternately junctioned together with the braids adjoining on opposite sides every required spacing in the knitting direction to assume a zigzag form, whereby the mesh openings of said mesh webs assume a polygonal shape.

In this case, the marquisette construction of one of the front and back mesh webs ensures that the net has a greater wale-wise and course-wise tensile strength and a superior wale-wise and course-wise dimensional stability and shape retainability, and satisfactorily retained pressure resistance. Therefore, the net can be suitably used particularly for applications where tensile strength is required.

Said three-dimensional net may be made such that in the knitting direction, the number of knitting courses for one or more larger mesh openings in one of the front and back mesh webs is equal to a plurality of times the number of knitting courses for one smaller mesh in the other mesh web, while in the knitting direction and in the knitting-width direction, one or more larger mesh openings in one of the front and back mesh webs correspond to a plurality of smaller mesh openings in the other mesh web which plurality is greater than the number of larger mesh openings.

In this way, a three-dimensional net of larger and smaller mesh openings on the front and back sides is easily produced by warp knitting, by freely setting sizes of the mesh openings on the front and back sides in accordance of usage.

In a preferred embodiment of the invention-wise three-dimensional net, in a plan view, at least one mesh opening on the second mesh web falls substantially in a middle portion of a larger mesh opening on the first mesh web, and connecting yarns being front-to-back-wise passed between the braids respectively defining said at least one mesh opening and said larger mesh opening in such a manner to surround entire peripheries of these mesh openings, so that the three-dimensional mesh spaces defined therein are substantially funnel-shaped.

In the three-dimensional net of such arrangement, the three-dimensional cords defining the three-dimensional mesh spaces have three-dimensional shape continuous in tunnel form and have three-dimensional voids that open with larger mesh openings. The three-dimensional voids are substantially triangular or the like in cross section, in such a manner to surround entire peripheries of these mesh openings. Thus, such arrangement makes a compressive load in the direction of the thickness to be distributed in a well-balanced manner, almost completely eliminating the direction dependency peculiar to double-web knitted fabrics, further improving the structural stability and pressure resistance.

In another preferred embodiment of the invention-wise three-dimensional net, in a plan view, junctions of braids on the second mesh web fall substantially on junctions of braids and middle portions of mesh openings on the first mesh web; and the invention-wise three-dimensional net comprises: vertical connecting yarns each passed between a junction on the first mesh web and a coincided junction on the second mesh web and inclined connecting yarns each passed between a junction on the first mesh web and rightward and leftward adjacent junctions on the second mesh web, each of said adjacent junctions falling substantially in a middle portion of a larger mesh opening on the first mesh web in a plan view.

Thus, the junction on the side associated with larger mesh openings has the Vertical connecting yarns and the connecting yarns rightwardly and leftwardly inclined, securing sufficient pressure resistance, preventing collapsing or falling, and also improving structural stability.

In another preferred embodiment of the invention-wise three-dimensional net, at discretionary positions in the knitting direction in the three-dimensional cords, each of the connecting yarns are passed from a first row of stitch on the first mesh web to a second row of stitch on the second mesh web, said second row of stitch being shifted rightward or leftward by at least one wale from a row of stitch coincided with the first row of stitch, thereby connecting yarns crossing each other in substantially X-form in the three-dimensional cords or three-dimensional mesh spaces. Thereby, the shape retainability of the three-dimensional cords is further improved, falling never occurs, and satisfactory cushioning property is retained in a direction perpendicular to the front and back surfaces, so that satisfactory pressure-resisting strength that is substantially uniform throughout the net can be retained.

In a still another preferred embodiment of the invention-wise three-dimensional net, at required places in the knitting direction, the size and/or shape of the mesh openings in the front and back mesh webs is varied. Thus, partly varying the size or shape of the mesh openings in the front and back mesh webs improves balance with respect to a compressive load in the direction of the thickness, suppresses the direction dependency peculiar to double-web knitted fabrics made by warp knitting, and further improves wale-wide and course-wise dimensional stability, structural stability, pressure resistance, etc. Further, it is also possible to provide aesthetic variations.

Said three-dimensional net of the present invention may have devoid portions devoid of the connecting yarns between front and back braids that are formed in discretionary positions in a knitting direction at each of the three-dimensional cords and/or at discretionary one(s) of the three-dimensional cords arranged in a knitting-width direction, in such a manner said devoid portions facilitate communication in the knitting direction and/or in the knitting-width direction.

According to this three-dimensional net, since the space portions having no connecting yarns in the three-dimensional cords define three-dimensional spaces substantially linearly communicating with each other in the knitting direction and/or in the knitting-width direction, it is possible to insert in said space portions long objects having various functions, such as members for connection to other members or for stretching of the net, particularly it is possible to insert said long objects crosswise. Thereby, the net can be suitably used as a composite material having functions according to uses.

Said three-dimensional net of the present invention may be arranged such that in selvages on both ends in a knitting-width direction, at least one of the connecting yarns is omitted so as to form a sleeve continuous in the knitting direction. Thereby, members for adhesion or sewing for joining to other members or long-sized members for stretching or attaching the net can be inserted in the sleeve portions at the selvages on the opposite ends. The sleeve portions may be flattened and utilized for joining to other nets or sheets.

An invention-wise composite structural material is formed by stacking a plurality of three-dimensional nets according to any one of the above arrangements.

According to such composite structural material, stacking a plurality of three-dimensional nets ensures that the mesh web openings of two mutually abutting nets mutually act to control their deformation and direction dependency peculiar to double-web knitted fabrics, and that the abutting portions of the mesh webs serve as reinforcing layers in the intermediate region in the direction of the thickness, so that even if the thickness is considerably great, the shape retainability, structural stability and pressure resistance can be retained in a very satisfactory state as a whole. Further, for example, stacking mesh webs with their sides having larger mesh openings facing each other provides a structural material having an increased void content and smaller mesh openings appearing on the front and back sides. Further, by combining nets respectively having higher and lower degree of elasticity, it is possible to eliminate the feeling of touching the bottom with respect to pressing in the direction of the thickness. Therefore, this combination can be suitably used for various applications in which, for example, cushion materials mat materials, shock absorbers and other three-dimensional net structures can be used.

In said composite structural material, a plurality of three-dimensional nets constructed to be different in knitting gauge, yarn thickness and mesh size can be stacked. In this case also, it is possible to obtain composite structural materials having strength, elasticity and net mesh construction suited for respective uses.

Further, another composite structural material of the present invention is made by stacking any one of the three-dimensional nets of above-described construction and a net of another construction. In this case also, the shape retainability and structural stability of the three-dimensional nets are increased and this material can be suitably used for various applications that make use of the void retainability, elasticity and pressure resistance provided by the three-dimensional construction.

Another invention-wise composite structural material comprises a flat stuff selected from a group consisting of a knit fabric, a woven fabric, a pile fabric, a nonwoven fabric, a sheet of cottony fluff material, a sheet of urethane foam, a synthetic resin film, a paper and other sheet; a synthetic resin plate, a wood plate, a metal plate, and other plate; and a mat-shaped cushion stuff containing air, water or oil therein; said flat stuff being placed on and adhered to at least one of the front and back sides of the three-dimensional net and/or between the three-dimensional nets.

By this feature, the pressure resistance and structural stability of the three-dimensional net are improved. By utilizing each flat stuff and respective imparted property, the three-dimensional net may be used as a mat stuff, a cushion structural wall material or heat insulator or the likes Still another invention-wise composite structural material comprises gas-impermeable sheets or gas-permeable sheets being stuck on the front and back sides of the three-dimensional net to cover the latter; and at least one selected from a group consisting of gas, liquid, powder, a mixture thereof, and solid particles, which is enclosed or filled within the three-dimensional net. Thereby, the elasticity and pressure resistance possessed by the three-dimensional net, coupled with the deformability of the substance enclosed or filled therein, enables the composite structural material to be suitably utilized for beds, pillows and other bedding articles, chairs, sofas, shoe insoles, etc.

BEST MODE FOR EMBODYING THE INTENTION

Figure 1:
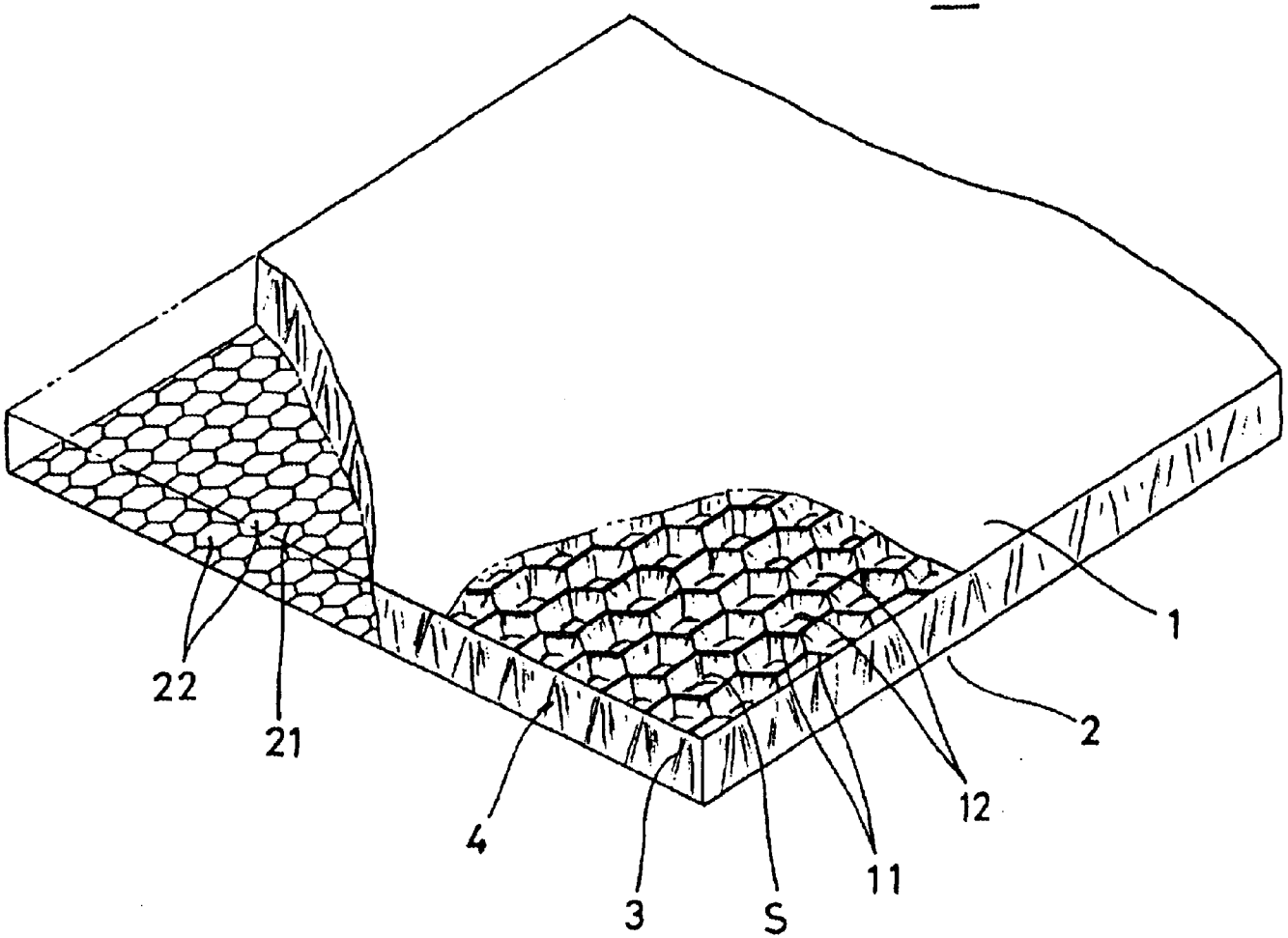
FIG. 1 is a perspective view, partly broken away, schematically showing a three-dimensional net according to an embodiment of the present invention.
Figure 2:
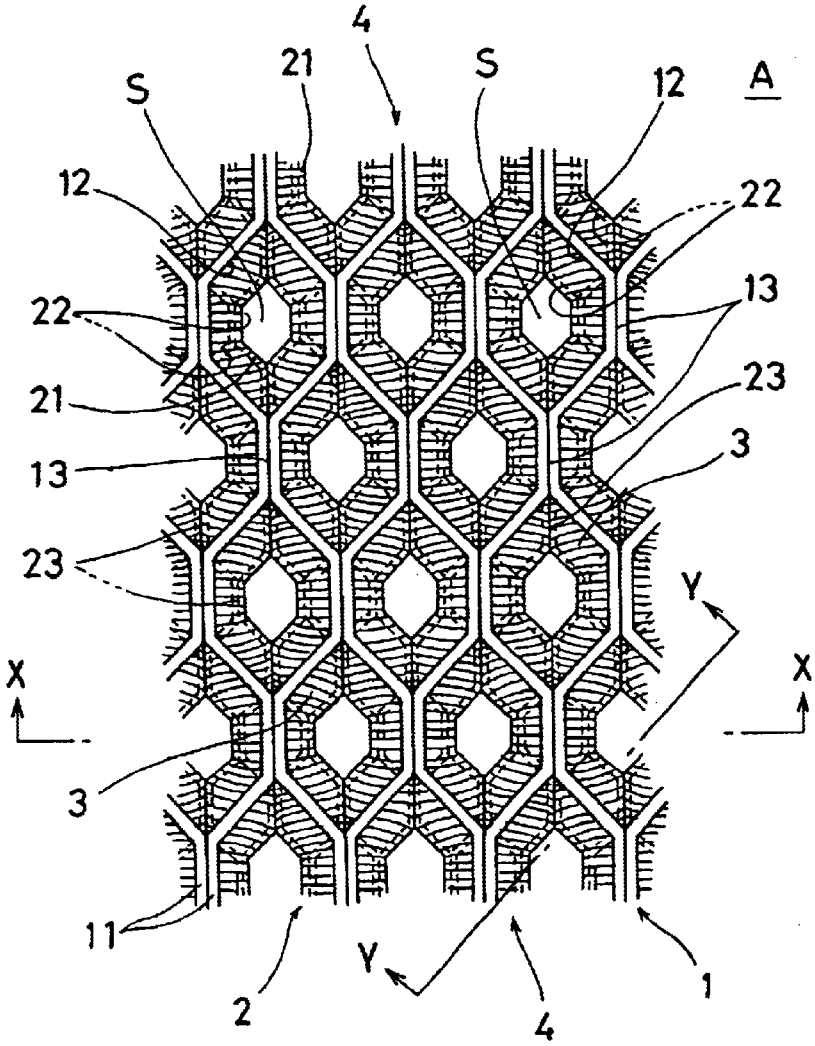
FIG. 2 is a schematic enlarged plan view of a portion of the above net.
Figure 3:
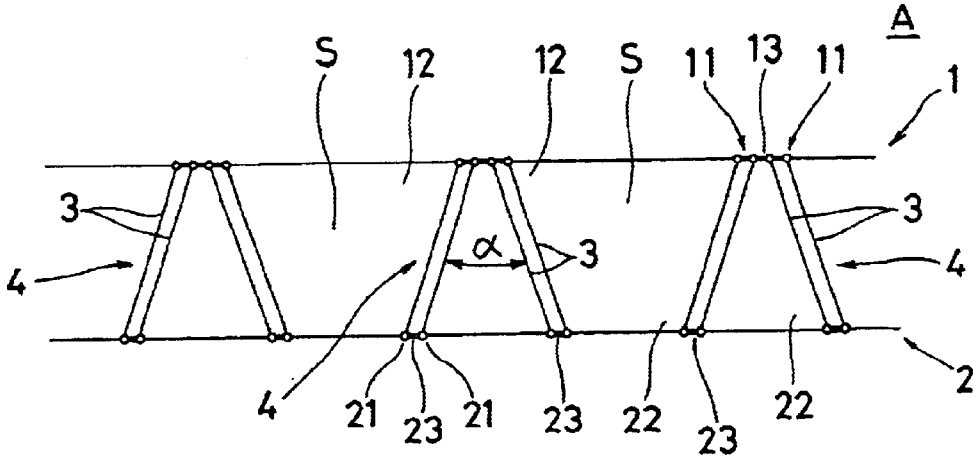
FIG. 3 is a schematic enlarged sectional view of a portion taken along the line X—X in FIG. 2.
Figure 4:
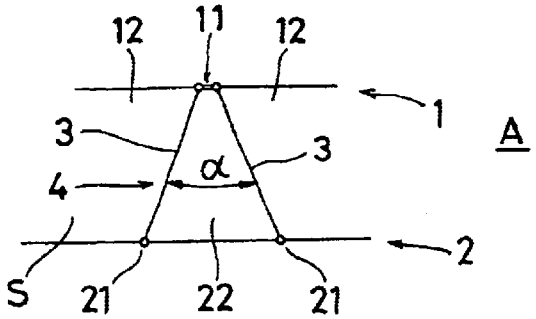
FIG. 4 is a schematic enlarged sectional view of a portion taken along the line Y—Y in FIG. 2.
Figure 5:
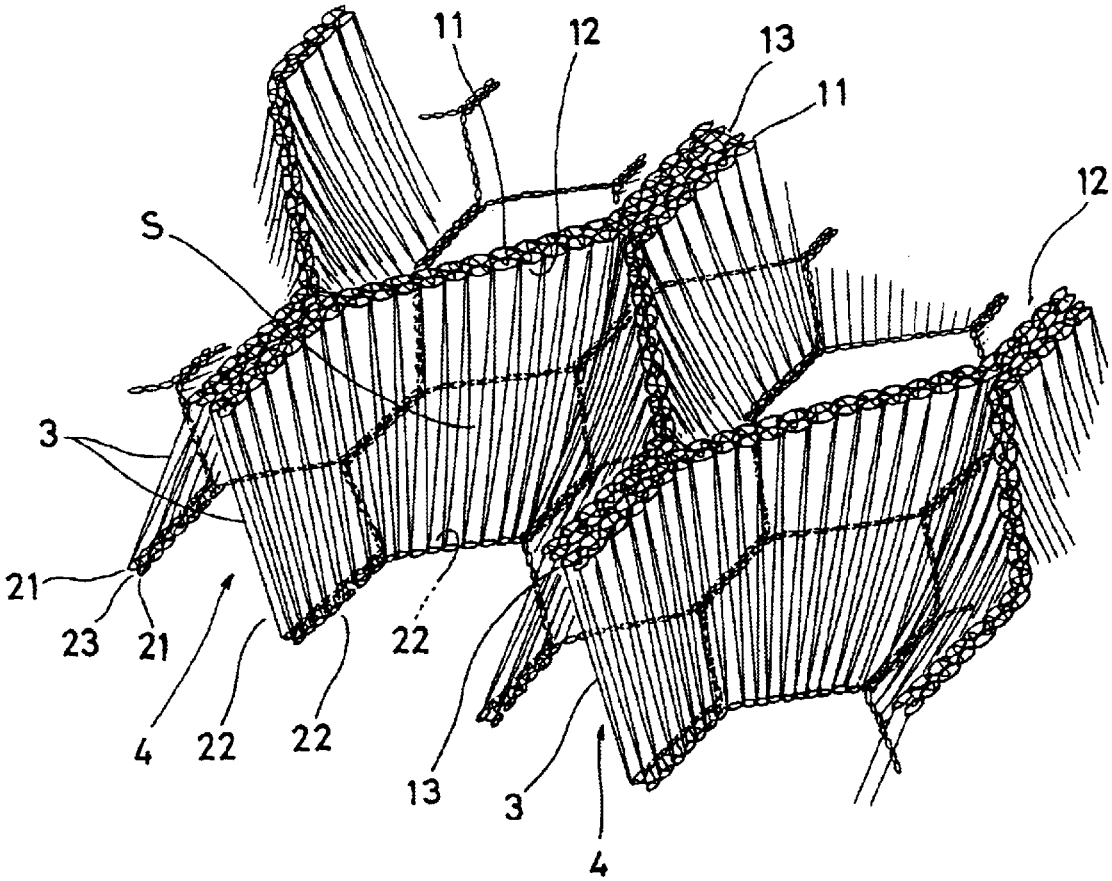
FIG. 5 is a fragmentary schematic enlarged perspective view of the above net.
Figure 6:
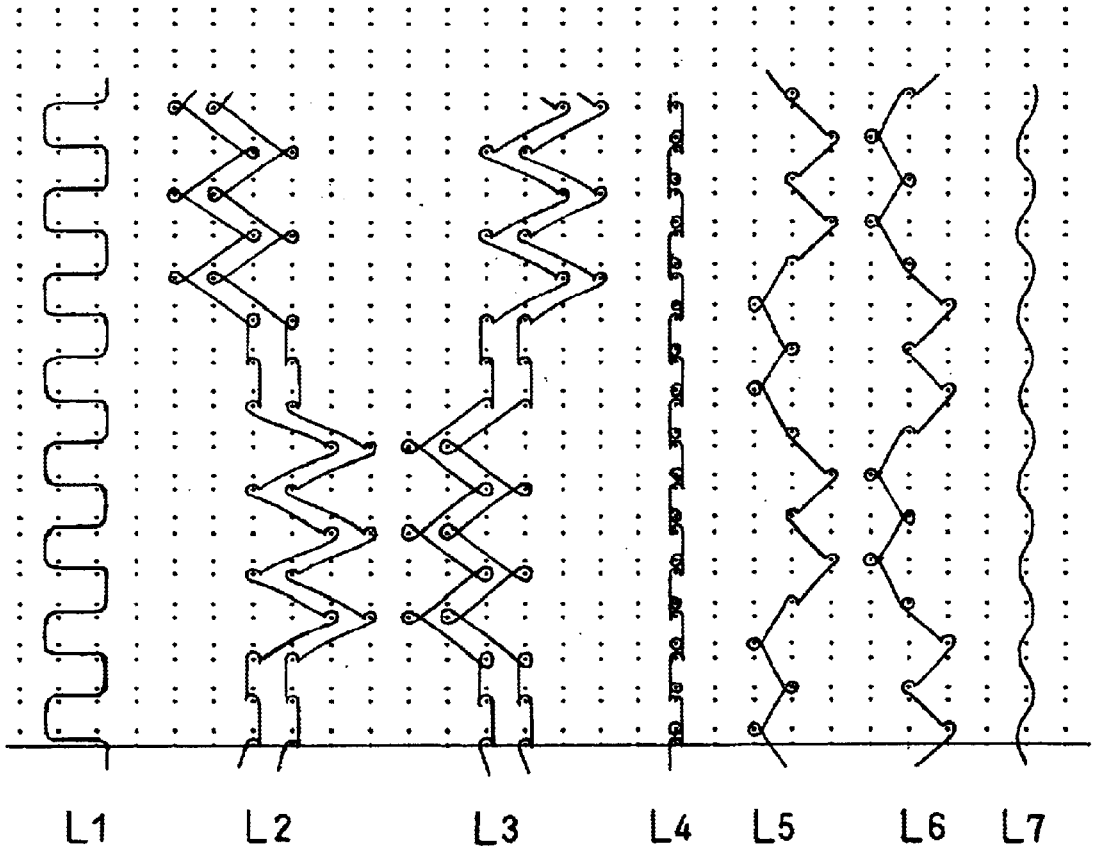
FIG. 6 is a lapping diagram of constituent yarns, showing an example of the knitting construction of the above net.

FIG. 1 schematically shows a three-dimensional net A according to an embodiment of the invention warp-knitted mainly of synthetic fiber yarns capable of imparting suitable degrees of rigidity and elasticity to the net. FIG. 2 is a fragmentary schematic enlarged plan view of said net. FIGS. 3 and 4 are fragmentary schematic enlarged sectional views taken along the lines X—X and Y—Y, respectively, in FIG. 2. FIG. 5 is a fragmentary schematic enlarged perspective view of said net. FIG. 6 shows the knitting construction of this three-dimensional net A.

In FIGS. 1 through 5, the numerals 1 and 2 denote front and back mesh webs; 11 and 21 denote braids that form mesh openings 12 and 22 of the front and back aides, respectively. The numeral 3 denotes connecting yarns connecting the front and back mesh webs 1 and 2 while leaving a required spacing therebetween. Thus, a three-dimensional net A having a required thickness and a high void content is formed.

In the three-dimensional net A of this embodiment, one of the front and back mesh webs 1 and 2, e.g., first mesh web 1 has mesh openings 12 larger than the mesh openings 22 of second mesh web 2, and connecting yarns 3 are passed and hung between the braids 11 defining the larger mesh openings 12 on the first mesh web 1 and the braids 21 defining the smaller mesh openings on the second mesh web 2, thereby forming three-dimensional cords 4 internally having voids capable of ventilation and water passage. In the whole or part of each said three-dimensional cord 4, said connecting yarns 3 are passed from a single braid 11 defining the larger mesh openings 12 to a plurality of braids 21 defining the smaller mesh openings 22. Thus, the three-dimensional cord 4 has, on the second mesh web 2, a width of at least one of the smaller mesh openings 22.

Particularly, the knitting is such that each the three-dimensional cords 4 has, in the whole or part thereof, the connecting yarns 3 are inclined as front-to-back-wise passed from the braids 11 defining the larger mesh openings 12 to the braids the 21 defining the smaller mesh openings 22. Thus, the three-dimensional cords 4 are substantially hollow three-dimensional and has three-dimensional voids therein that are substantially triangular, substantially inverted triangular, substantially trapezoidal, substantially inverted trapezoidal or the like, in cross sectional view. The three-dimensional spaces surrounded by the three-dimensional cords 4 are the three-dimensional mesh spaces S. In the three-dimensional cords 4, the passed and hung portions of the connecting yarns 3 that are rightwardly and leftwardly inclined perform a prop action against load in thickness-wise direction.

The three-dimensional cords 4 may be formed such that the three-dimensional voids defined by inclined connecting yarns 3 form tunnels continuous in the knitting direction and/or in the knitting-width direction, while placing the voids substantially in communication with each other.

Specifically, for example, the braids 11 defining the larger mesh openings 12 on the first mesh web 1 are formed by rows of stitches forming a plurality of wales (two wales in the case of the figure) using chain stitch yarns and inlay yarns to be transverse-wise inserted with respect to the chain knit wales. Meanwhile, the braids 21 defining the smaller mesh openings 22 in the second mesh web 2 are formed by rows of similar stitches forming wales (one wale in the case of the figure) smaller in number than in the braids 11 defining the larger mesh openings 12, each of such braids being alternately junctioned with rightward and leftward adjacent braids at required intervals in the knitting direction. Thus, the braids are continuous in zigzags in the knitting direction, so that substantially hexagonal, substantially quadrangular (rhombic or the like) or other polygonal mesh openings 12 and 22 are formed on the first and second mesh webs 11 and 12.

The connecting yarns 3 are passed and hung between rows of stitches forming the corresponding wales of the braids 11 and 12 of the first and second mesh webs 1 and 2. All or part of the connecting yarns 3 in or in each of the three-dimensional cords 4 are rightwardly and leftwardly inclined, and are passed and hung from each of the braids 11 defining the larger mesh openings 12 to two or more braids 21 (in the case of the figure, two braids) defining the smaller mesh openings 22, as described above. In this way, the three-dimensional cords 4 are hollow three-dimensional and has three-dimensional voids therein as. The numeral 13 denotes the junction of braids 11; and 23 denotes the junction of the braids 21, 21.

The proportions of the size of the larger mesh openings 12 of said one mesh web 1 and the smaller mesh openings 22 on the second mesh web 2 may be suitably optionally set both in the knitting direction and in the knitting-width direction. The proportions may be set such that in the knitting direction and in the knitting-width direction, one larger mesh opening 12 corresponds to a plurality of smaller mesh openings 22 or such that a plurality of larger mesh openings 12 correspond to a plurality of smaller mesh openings 22 (however, the number being greater than that of larger mesh openings). Such setting facilitates warp knitting.

In an example shown in FIGS. 1–5, in the knitting direction, the number of knitting courses for one larger mesh opening 12 in first mesh web 1, that is, the number of knitting courses from one junction 13 to the next junction 13 is twice the number of knitting courses for one smaller mesh opening 22 in the other mesh web 2. In other words, the larger mesh opening 12 has twice the size of the smaller mesh opening 22. On the other hand, in the knitting-width direction, one larger mesh opening 12 on the first mesh web 1, which is one of the front and back mesh webs, corresponds to two smaller mesh openings 22 on the second mesh web 2, that is, the larger mesh opening has twice the width of the smaller mesh opening, Though not shown, the knitting may be such that in the knitting direction, the number of knitting courses for one larger mesh opening 12 on the first mesh web 1 corresponds to the number of knitting courses for three smaller mesh openings 22 on the second mesh web 2 and such that in the knitting-width direction, one larger mesh opening 12 corresponds to two smaller mesh openings 22.

Further, in the example shown in FIGS. 1–5, in the knitting direction, the knitting is such that one smaller mesh opening 22 on the second mesh web 2 is correspondingly positioned substantially in the middle of a larger mesh opening 12 on the first mesh web 1. The connecting yarns 3 are passed and hung between the braids 11 and 21 defining these corresponding two mesh openings 12 and 22 and over the entire periphery of the mesh openings 12 and 22, so that three-dimensional mesh spaces S defined therein are substantially funnel-shaped.

Thus, the three-dimensional cords 4 formed around the three-dimensional mesh spaces S are substantially hollow three-dimensional, for example, substantially triangular in cross section and have three-dimensional voids therein over the entire periphery of each of the three-dimensional mesh spaces S. Such three-dimensional structure is continuous to form tunnels. Thus, the three-dimensional net can support a compressive load in the thickness-wise direction In a well-balanced manner. Further, since the three-dimensional cords 4 of forming the three-dimensional structure are connected to each other to form a tunnel structure continuous throughout the three-dimensional net, the structural stability and anti-collapse or fall-preventive effect are further enhanced. Moreover, the internal three-dimensional voids can be effectively utilized as distribution spaces for ventilation, water passage, etc.

The knitting is effected by setting the size of the mesh openings and the thickness of the three-dimensional net such that the three-dimensional cord 4 is nearly an equilateral triangular in cross section. An angle $\alpha$ formed by the passed and hung portions of the connecting yarns 3, which are rightwardly and leftwardly inclined from the braids 11 for the larger mesh openings 12, is preferably from 45° to 75° and especially preferably about 60°. By this range of angle $\alpha$, the structural stability becomes optimum. However, depending on the thickness of the net or the size of the mesh openings required according to uses or to yarns to be used, the angle may be greater or smaller than said angle, not being limited said value.

The three-dimensional net A is warp-knitted on a double Raschel machine having two rows of needle beds, and a specific example of the knitting will now be described with reference to FIG. 6.

On the front side of the double Raschel machine, following knitting is repeated. Each of two (types of) chain stitch guide bars L2 and L3 guides two chain stitch yarn in alternation with other chain Stitch guide bar L2 or L3, while an inlay yarn guide bar L1 guides an inlay yarn. An inlay yarn is traverse-wise inserted into every two successive chain stitch wales formed by the chain stitch guide bars L2 and L3. In this way, each braid 11 of the first mesh web 1 on the front side is knitted by two wales of rows of stitches. In a course position corresponding to a junction 13, the chain stitch yarns guided by said guide bars L2 and L3 for chain stitches are rightwardly and leftwardly shifted by two wales in alternate manner to join each of the braids 11 with rightward and leftward adjacent braids 11.

On the back side, unlike the front side, following knitting is repeated. Each of two (types of) chain stitch guide bars L5 and L6 guides one chain stitch yarn in alternation with each, other, while an inlay yarn guide bar L7 guides an inlay yarn into every wale formed by the chain stitch guide bars L2 and L3. The inlay yarn is inserted into the chain stitch wale in a zigzag fashion. In this way, each of the braids on the second mesh web 2 is knitted to be formed by one wale of row of stitches. Then, junctions are formed as follows. The chain stitch yarns guided by the chain stitch guide bars L5 and L6 are rightwardly and leftwardly shifted by one wale in alternate manner to join each of the braids 11 with rightward and leftward adjacent braids 11. Such shifting is made at interval of half number of the knitting courses on the front side, or on the first web mesh. For example, such shifting is made at a course position coincided with the junction on the front side and at a course position between two successive junctions on the front side. In this way, the second mesh web 2 on the back side is formed with mesh openings 22 having a length in the knitting direction and a width that are half the length and width of the mesh openings 12 on the front side, as shown in FIG. 2.

The connecting yarns 3 connect front mesh web 1 and back mesh web 2 in following way, by stitching. The connecting yarn guide bar L4 guides the connecting yarns 3 through each wale in such a manner that the connecting yarns 3 pass alternately through two wale of the row of stitches forming the braids 11 on the first mesh web 1 on the front side, and then through corresponding rows of stitches forming the braids 21 on the second mesh web 1 on the back side.

Though not particularly shown, when two types of connecting yarn guide bars (or two connecting yarn guide bars) are used, connecting by stitching may be carried out as follows. At the portion where the chain-stitch guide bars L2 and L3 are rightwardly and leftwardly shifted to each other by two wales in an alternate manner to form a junction, the two connecting yarn guide bars may also be rightwardly and leftwardly shifted to each other by two wales in an alternate manner to perform a knitting as connected. Such construction improves uniformity of strength between the front and back mesh webs and structural stability of the net. Similarly, also at the position corresponding to Y—Y in FIG. 1, the connecting yarns are guided to be rightwardly and leftwardly shifted by two wales to each other, such that the connecting yarns cross each other to improve stability against traverse-wise collapse or inclination of the three-dimensional cords.

The three-dimensional net formed as above gives following three-dimensional construction when simply by unrolling and spreading of the net in the knitting-width direction: The connecting yarns 3 are inclined both rightward and leftward as seen from a braid 11 associated with larger mesh openings 12 and are passed to two braids 21 associated with the smaller mesh openings 22; the three-dimensional cords 4 constitute a substantially hollow three-dimensional structure having three-dimensional voids therein that are substantially triangular or the like in cross section continuous like tunnels; and the three-dimensional mesh spaces S surrounded therewith are substantially funnel-shaped between the mesh openings 12 and 22 on the front and back sides. Furthermore, since one mesh opening 22 is smaller than the other mesh opening 12, it can be easily spread or deployed as described above and the three-dimensional shape stability and dimensional stability in the spread state are improved.

Therefore, if the net knitted in the manner described above is suitably spread or deployed in the knitting-width direction and heat-set as occasion arises, suitable degrees of shape retainability, rigidity and elasticity are imparted to the yarns used, so that a stabilized three-dimensional net A in the form shown in FIGS. 1 through 5 is obtained. Furthermore, the mesh openings 22 on the second mesh web 2, which is one of the front and back mesh webs, are smaller so that the surface of the front mesh web looks good and feels nice to the touch. When the net is covered with a sheet, the surface unevenness of the net hardly appears on the outer surface.

Therefore, said three-dimensional net A with one of the front and back mesh webs 1 and 2 having larger mesh openings 21 and the other having smaller mesh openings 22 is high in void content, light in weight, stabilized in size and shape, and can be suitably utilized particularly in applications where pressure resistance and structural stability are required, including mat materials, cushion materials, and their intermediate materials, such as cores and pads, cover materials, and stuffing for pillows, bags, and shoes.

Further, in the case where yarns having drapability are used for the front and back mesh webs 1 and 2, the three-dimensional structure is obtained simply by spreading the net as described above, thus finding wider use as spacers for clothing, sports and outdoor goods, interior materials, curtains, hats, wrist bands, protectors, vests, shirts, underpants, etc.

Further, the inner three-dimensional spaces of said three-dimensional cords 4 can be effectively utilized as passages for air and water. For example, said three-dimensional net is suitable for use as vegetation net for greening and stabilization of the faces of slopes, etc. That is, in the use as a vegetation net, the tunnel-like inner spaces of the three-dimensional cords 4 provide good drainage and ventilation and ensure efficient distributive drainage during raining to prevent flow of excessive amount of water into the faces of slopes, thus preventing erosion and landslide due to rainwater. Further, stabilization of the three-dimensional shape increases the strength by which soil dressing and plants are held while the smaller mesh openings 22 on one surface prevents soil dressing on the faces of slopes from being washed away or crumbling, Further, the three-dimensional net can also be used for constructional or agricultural water feeding and draining.

Figure 7:
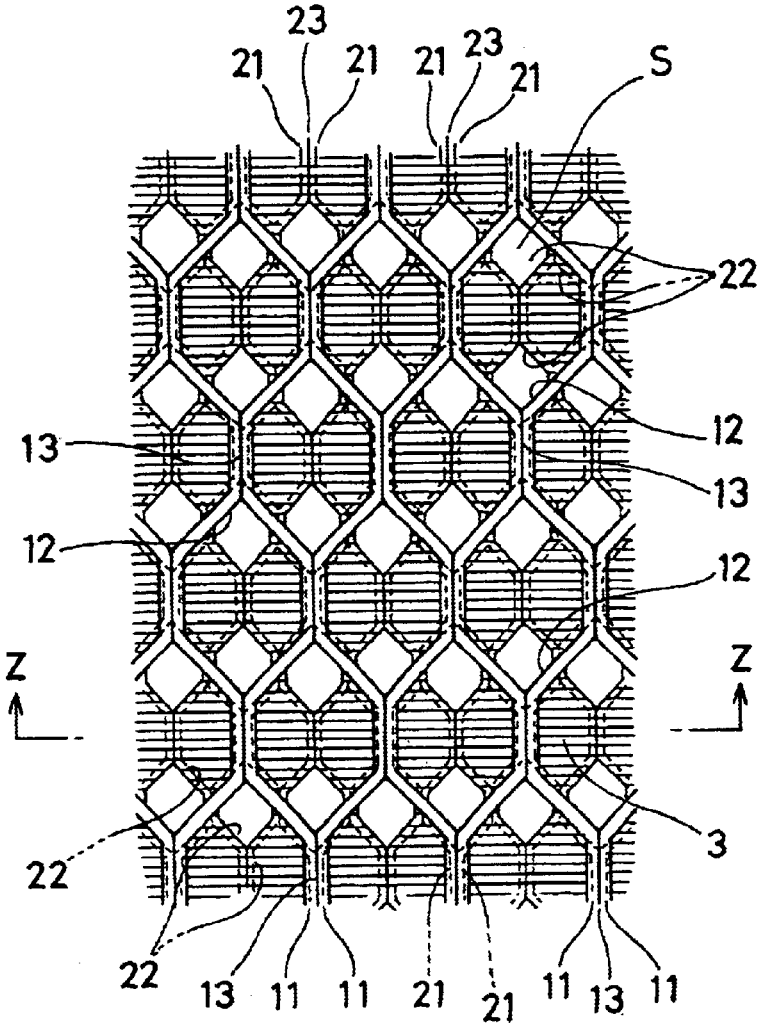
FIG. 7 is a fragmentary schematic plan view, showing a net according to another embodiment of the invention.
Figure 8:
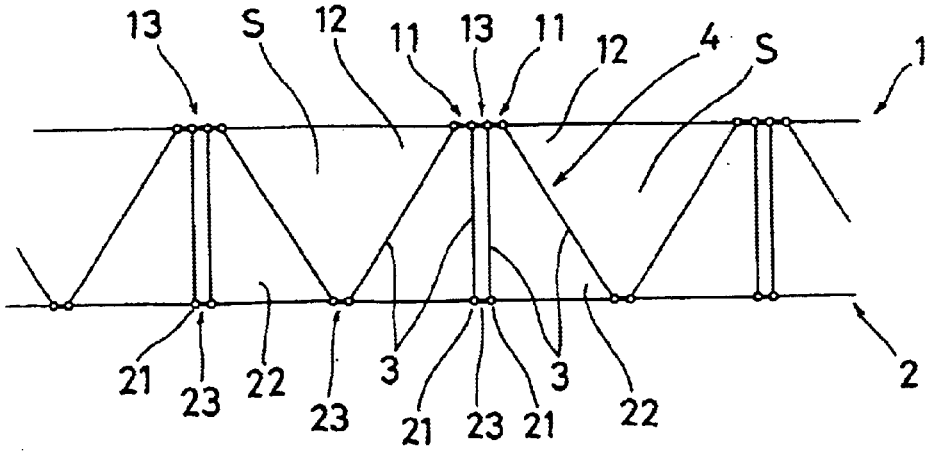
FIG. 8 is a fragmentary schematic enlarged sectional view taken along the line Z—Z in the preceding figure.

FIGS. 7 and 8 show a three-dimensional net A according to a second embodiment of the invention. In this embodiment, the net is knitted as in a following manner. At the junction 13 of the braids 11 in the first mesh web 1 associated with the larger mesh openings 12 in either the front side or the back side, and substantially at the middle of the larger mesh opening 12, the junction 23 of the braids 21 on the second mesh web 2 is correspondingly positioned. From the junction 13 associated with the larger mesh openings 12, vertical connecting yarns 3 are passed br extended to the junction 23 at coincided position on the second mesh web 2. From the junction 13, inclined connecting yarns 3 are also passed or extended to a rightward adjacent junction 23 and a leftward adjacent junction 23 on the second mesh web 2, which are positioned to fall substantially in the middle of the larger mesh opening 12. Thereby, in this portion, the three-dimensional cords 4 form substantially hollow three-dimensional shapes having three-dimensional voids therein that are substantially triangular, substantially inverted triangular, substantially trapezoidal, substantially inverted trapezoidal, or the like in cross section.

In the case of this embodiment, the three-dimensional mesh spaces S surrounded by the three-dimensional cords 4 have an opening in a dimension of the larger mesh opening 12 on the first mesh web 1 and have two openings, which are smaller mesh openings 22, on the second mesh web 2.

And to resist the compressive load in the direction of the thickness in said junction 13, the portion between the rightward and leftward inclined connecting yarns 3 exerts a prop action and controls swaying or falling, while the vertical connecting yarns 3 support the vertical load, as shown in FIG. 8, so that satisfactory pressure resistance can be exerted as a whole; thus, the net can be suitably utilized for various applications.

The three-dimensional net A in this embodiment is basically of the same yarn guide construction as in the knitting construction shown in FIG. 6 and can be obtained by knitting by shifting the junction course position on the back side in the knitting direction by the number of courses corresponding to ¼ of one repeat as compared with the case of FIG. 6.

Figure 9:
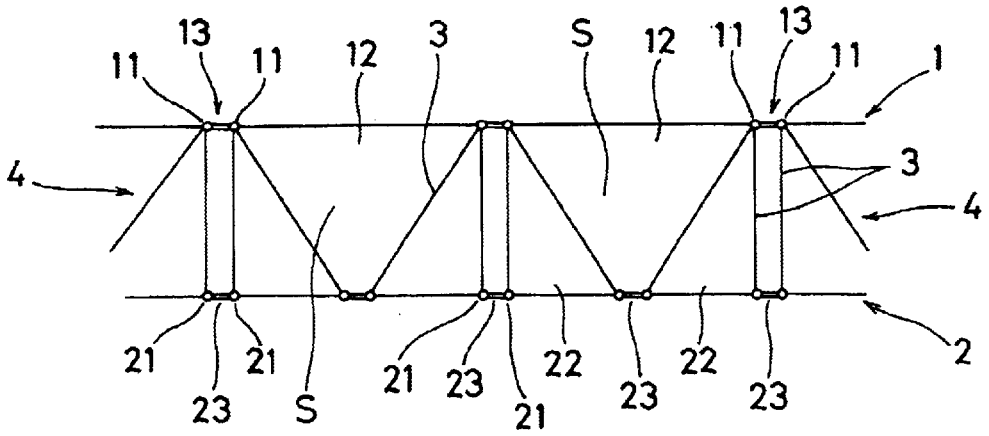
FIG. 9 is a fragmentary schematic enlarged sectional view, showing a net according to still another embodiment of the invention.

In addition, as for the braids 11 of the mesh web 1 forming the larger mesh openings 12 on one of the front and back sides, they are formed by a plurality of wales as in the embodiment described above. Besides this, they may be formed by a row of stitches forming one wale as shown in FIG. 9 using particularly two types of connecting yarn guide bars. In this case, the braids 21 associated with the other mesh web 2 forming the smaller mesh openings 22 are also formed by a row of stitches forming one wale.

Figure 10:
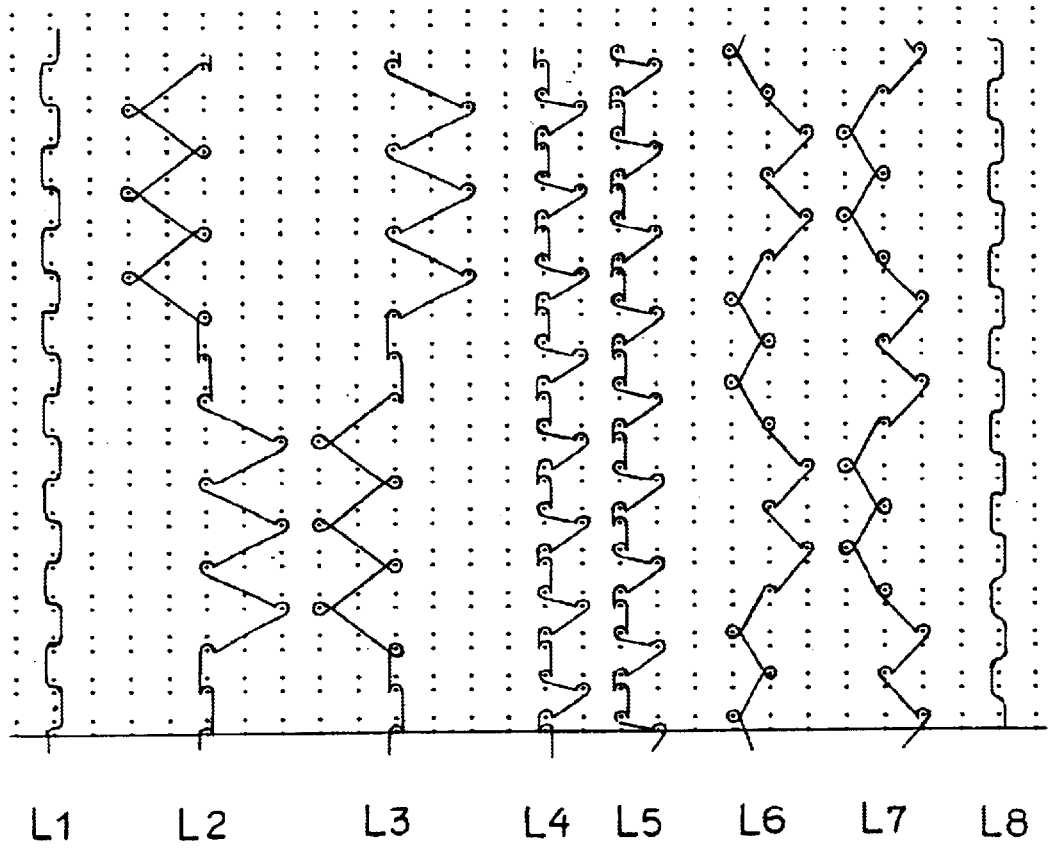
FIG. 10 is a lapping diagram of constituent yarns, showing an example of the knitting construction of the above net.

FIG. 10 shows an example of the knitting construction thereof. On the front side, two types of chain stitch guide bars L2 and L3 for alternately guiding chain stitch yarns one by one and the inlay yarn guide bar L1 for guiding the inlay yarns every wale are used to knit the braids 11 formed of one wale of a row of stitches, which define larger mesh openings 12. On the back side, chain stitch guide bars L6 and L7 and an inlay yarn guide bar L8 are used to knit braids 21 formed of one wale of a row of stitches, which define smaller mesh openings 22. Two types of connecting yarn guide bars L4 and L5 that alternately guide connecting yarns 3 one by one are used to knit connecting yarns by shifting them to adjacent wales and obliquely extending them when guiding them from front to back and from back to front for each course.

Thereby, in spite of the fact that braids forming larger mesh openings are of a row of stitches forming one wale, the connecting yarns 3 are rightwardly and leftwardly inclined as seen from the braids 11 associated with the larger mesh openings 12 and extended to two braids 21 associated with the smaller mesh openings 22. Thus formed three-dimensional cords 4 in the net have three-dimensional voids that are substantially triangular or the like in cross section.

Figure 11:
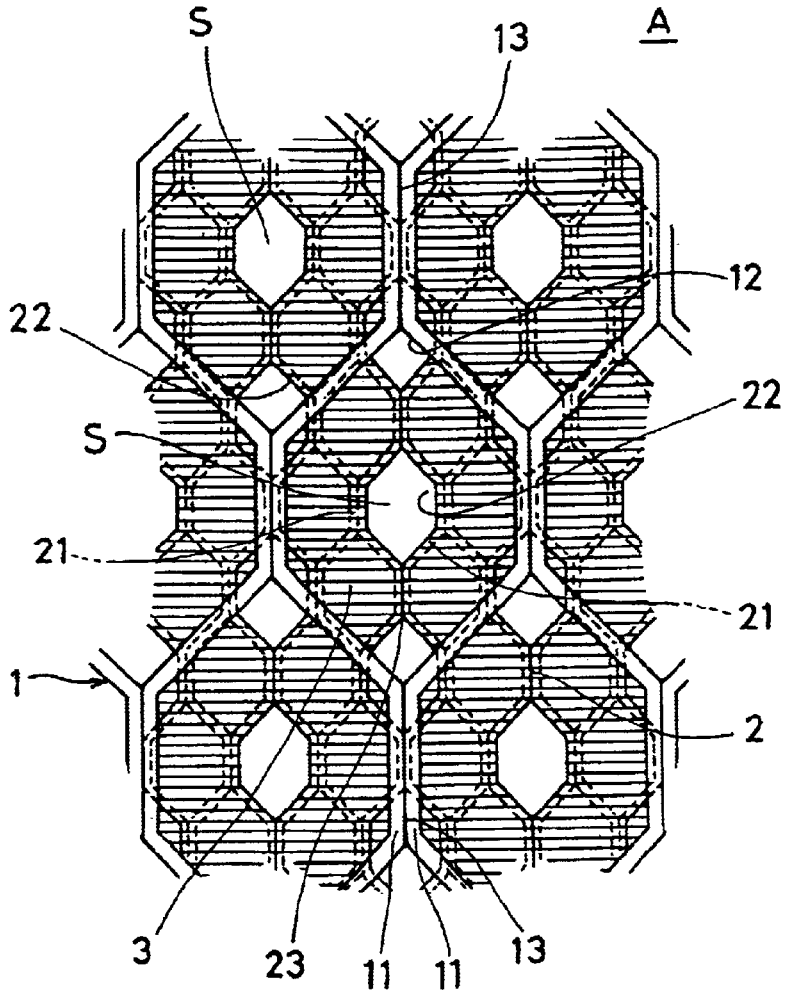
FIG. 11 is a fragmentary schematic plan view, showing a net according to still another embodiment of the invention.
Figure 12:
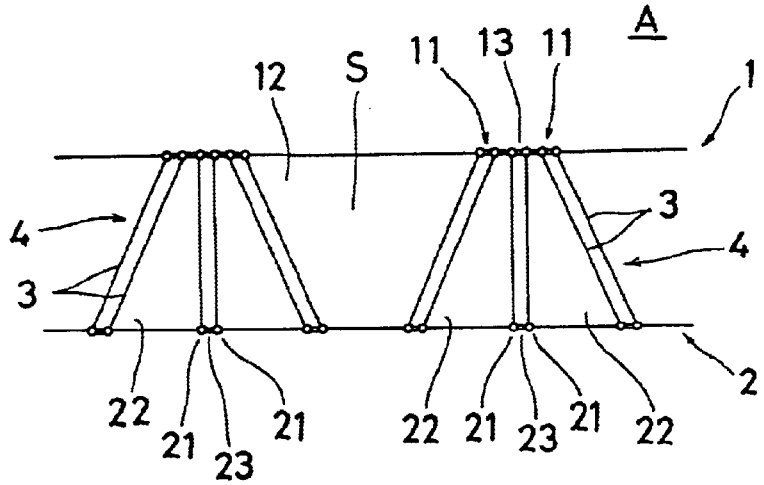
FIG. 12 is a fragmentary schematic enlarged sectional view of the above net.

FIGS. 11 and 12 show an example in which the braids 11 on the first mesh web 1 defining the larger mesh openings 12 are knitted by rows of stitches forming three wales. The braids 21 on the second mesh web 2 are knitted by a row of stitches forming one wale. The connecting yarns 3 are passed and hung between the rows of stitches on the first and second mesh webs. In this way, stabilized substantially hollow three-dimensional cords 4 are formed whose cross section is, at least in part, substantially triangular or substantially trapezoidal or the like.

Figure 13:
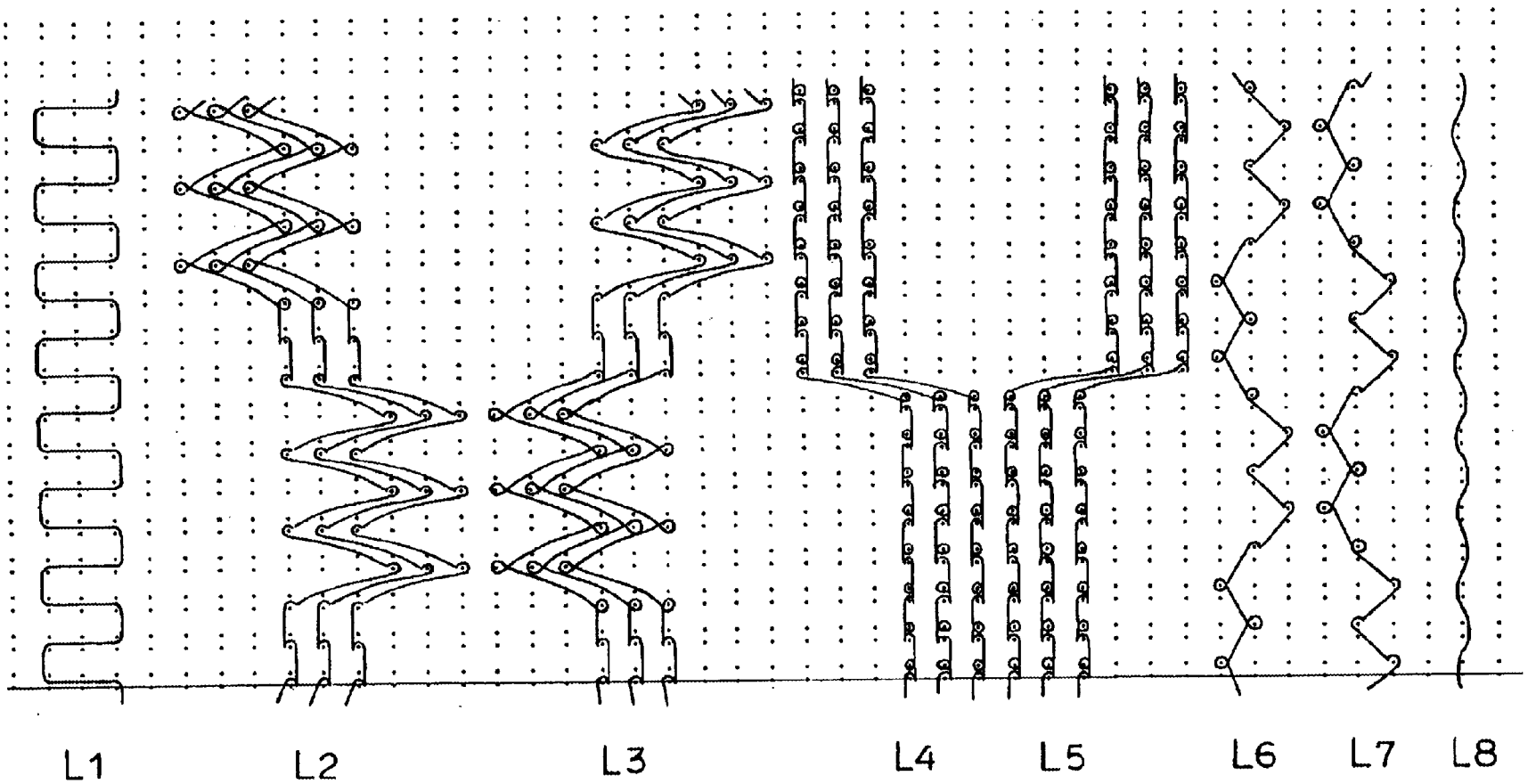
FIG. 13 is a lapping diagram of constituent yarns, showing an example of the knitting construction of the above net.

FIG. 13 shows the knitting construction of the three-dimensional net A. On the front side, each of the chain stitch guide bars L2 and L3 guides three successive wales of stitch yarns in alternation with the other guides. An inlay yarn is inserted to traverse each group of the three successive wales by traverse-sway motion of the inlay yarn guide bar L1 to form a junction. The traverse-sway motion is a rightward and leftward alternate shifting by the three wales and is made at interval of certain length of knitting course tantamount to a mesh opening 12. In this way, each of the braids 11 defining the larger mesh openings 12 is knitted.

On the back side, as in the preceding embodiment, each of the chain stitch guide bars L6 and L7 guides a stitch yarn forming each one wale in alteration with the other guide bar the inlay yarn guide bar L8 for guiding the inlay yarns L6 or L7. An inlay yarn is inserted to traverse each wale by traverse-sway motion of the inlay yarn guide bar L1 to form a junction. The traverse-sway motion is a rightward and leftward alternate shifting by the three wales and is made at interval of certain length of knitting course tantamount to the mesh opening 22. In this way, each of the braids 21 defining the mesh openings 22 is knitted.

The role of the inlay yarns guided by the inlay yarn guide bars L1 and L8 is to stabilize the mesh opening shape on the mesh webs and ensure the dimensional stability of the entire net. Further, if elastic yarns are used as inlay yarns, stretchability can be imparted. Further, if heat-shrinkable yarns are used as inlay yarns, the mesh webs become further tight and shape stability can be further enhanced.

As for the connecting yarns 3, each of two connecting yarn guide bars L4 and L5 guides connecting yarns for three successive wales in alteration with the other guide bars L4 or L5, so that the connecting yarns are passed and hung from a wale of stitches on the first mesh web 1 to a coincided wale of stitches on the second mesh web 2. Meanwhile, connecting yarns are traversely shifted by several wales at a required course position in this way, the first and second mesh webs 1 and 2 are connected by knitting.

Knitting in this manner results, as shown in FIGS. 11 and 12, in substantially triangular or substantially trapezoidal substantially hollow three-dimensional cord 4 being formed at least at the junctions 13 between the braids 11 forming the larger mesh openings 12. The portion surrounded by this three-dimensional cord 4, as in the illustrated example, is a three-dimensional mesh space S that opens at the larger mesh opening 12 on the first mesh web 1 and opens at one or a plurality of smaller mesh openings 22 on the second mesh web 2. The three-dimensional mesh space S is substantially funnel-shaped, extending from the larger mesh opening 12 to the smaller mesh opening 22. Further, the three-dimensional cords 4 form tunnels continuous in the knitting direction and/or in the knitting-width direction. In addition to this, partial crossing of the connecting yarns increases shape stability in the knitting-width direction.

Therefore, the net, as in the embodiment shown in FIGS. 1 through 5, is superior in pressure resistance, structural stability and fall-prevention or collapse-prevention effect and capable of securing passages for air and water by means of three-dimensional cords, finding various suitable uses including mat materials, cushion materials, spacers for clothing, and vegetation nets.

In addition, in the case where each of the braids 11 on the first mesh web 1 is formed by rows of stitches forming three wales, knitting may be effected by omitting a connecting yarn passed between one wale of stitches on the first mesh web and a coincided wale of stitches on the second mesh web.

Besides this, knitting may be embodied such that the braids that define the larger mesh openings of one of the front and back mesh webs are formed by a plurality of rows of stitches forming mote than three wales while the braids that define the smaller mesh openings of the other mesh web are formed by rows of stitches forming a smaller number of wales than in said braids forming the larger mesh openings.

Figure 14:
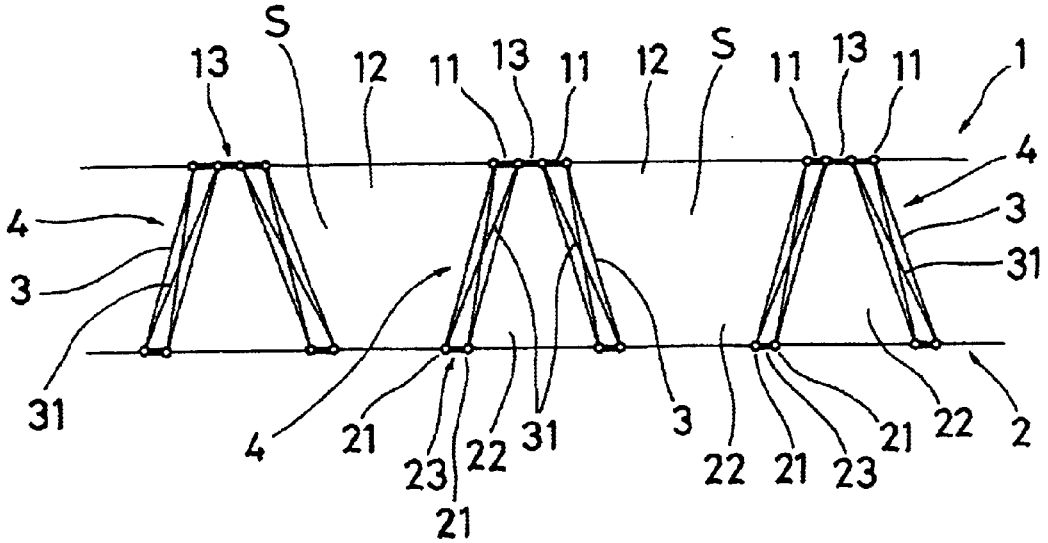
FIG. 14 is a fragmentary schematic enlarged sectional view, showing a net according to still another embodiment of the invention.
Figure 15:
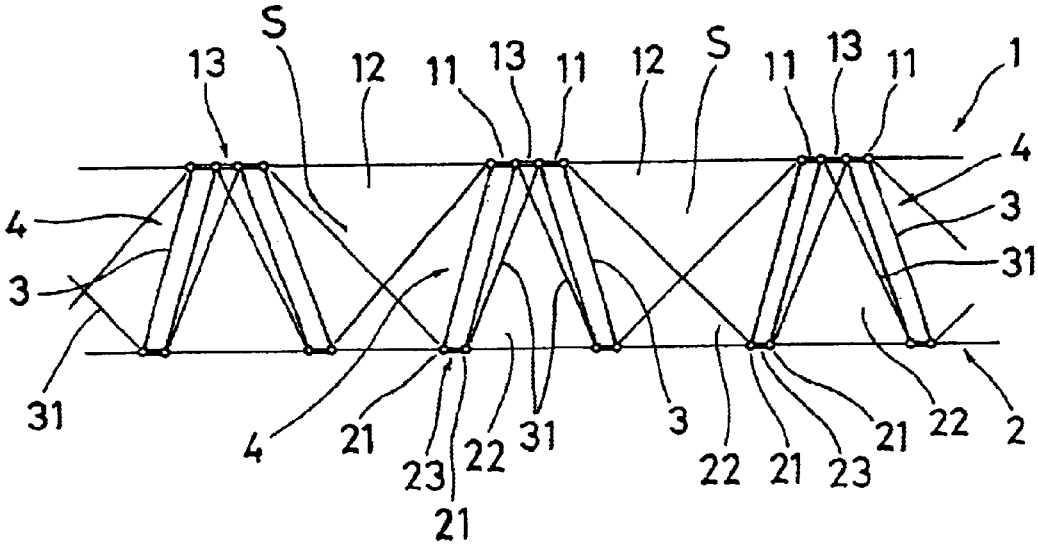
FIG. 15 is a fragmentary schematic enlarged sectional view showing an example that differs from the net of the preceding figure in the manner of the extending of inlay yarns.
Figure 17:
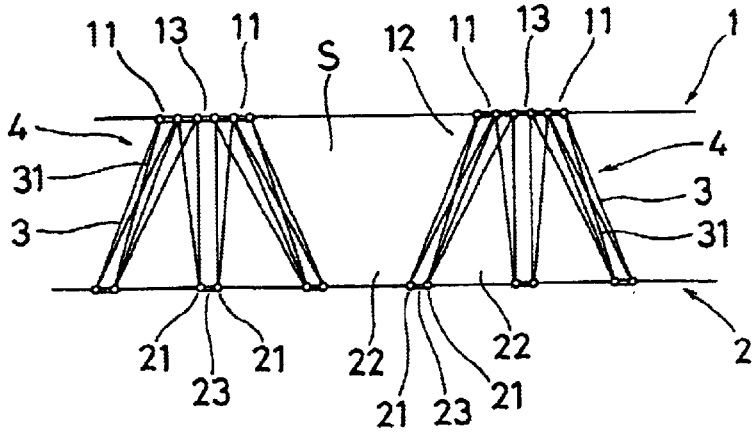
FIG. 17 is a fragmentary schematic enlarged sectional view, showing a net according to still another embodiment of the invention.

In the three-dimensional net in each of the embodiments described above, the connecting yarns 3 passed and hung between the first and second mesh webs 1 and 2 may cross each other in substantially X-form at discretionary positions in the three-dimensional cord 4 and/or in the three-dimensional mesh space S, as exemplary shown in FIGS. 14, 15 and 17. In such case, the connecting yarns 3 are traverse-wise shifted by at least one wale, for example by two or three wales, as being passed from the first mesh web 1 to the second mesh web 2, at discretionary positions in the knitting direction for the three-dimensional cords 4.

By this construction, the shape retaining strength of the three-dimensional cords 4 is increased, falling hardly occurs and the three-dimensional construction is satisfactorily retained. Particularly, the obliquely inclined connecting yarns overlap, having a relatively mild cushioning effect in the direction normal to the surfaces of the front and back mesh webs (in the direction of the thickness of the net) and improving the pressure resistance.

Figure 16:
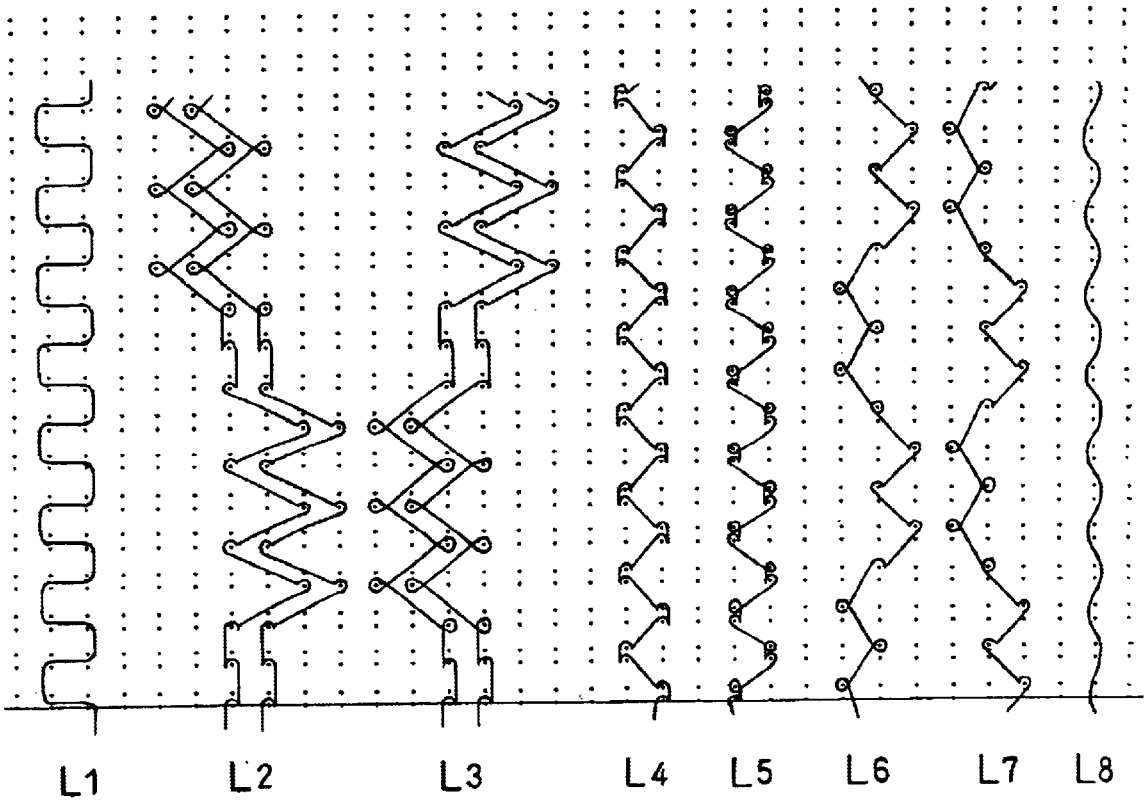
FIG. 16 is a lapping diagram of constituent yarns, showing an example of the knitting construction of the net shown in FIG. 14.

A three-dimensional net A of FIG. 14 is knitted, for example, with a knitting construction shown in FIG. 16. In this knitting construction, the front side is knitted by the chain stitch guide bars L2 and L3 and the inlay yarn guide bar L1, while the back side is knitted by the chain stitch guide bars L6 and L7 and the inlay yarn guide bar L8, in the same manner as in the knitting construction shown in FIG. 6 using L2, L3 and L1, and L5, L6 and L7, respectively. However, two types of connecting yarn guide bars L4 and L5, each of which guides one connecting yarn into each of the two wales, are used for alternately guiding the connecting yarns, so that the connecting yarns 3 is shifted to rightward and leftward adjacent wale as being passed between the first and second mesh webs. The shifting is made at interval of required courses. The knitting construction of FIG. 16 shows a case where the connecting yarns 3 are guided by the connecting yarn guide bars L4 and L5 in such a manner as to correspond to two wales in the braids 11 defining the larger mesh openings 12.

Using a different method of guiding inlay yarns in said knitting construction, knitting is effected such that the connecting yarn guide bars L4 and L5 guide the connecting yarns 3 to adjacent wales for adjacent braids 11 on the second mesh web 2. Thus, as shown in FIG. 15, for example, the passed and hung portions 31 of the connecting yarns 3 may cross each other in substantially X-form in the three-dimensional mesh spaces S and in the three-dimensional cords 4. The inclination angle of the connecting yarns 3 may be further increased, in accordance with the relation between the thickness of the net and the smaller mesh openings 22, so as to provide a three-dimensional net having enough thickness and stability.

Figure 18:
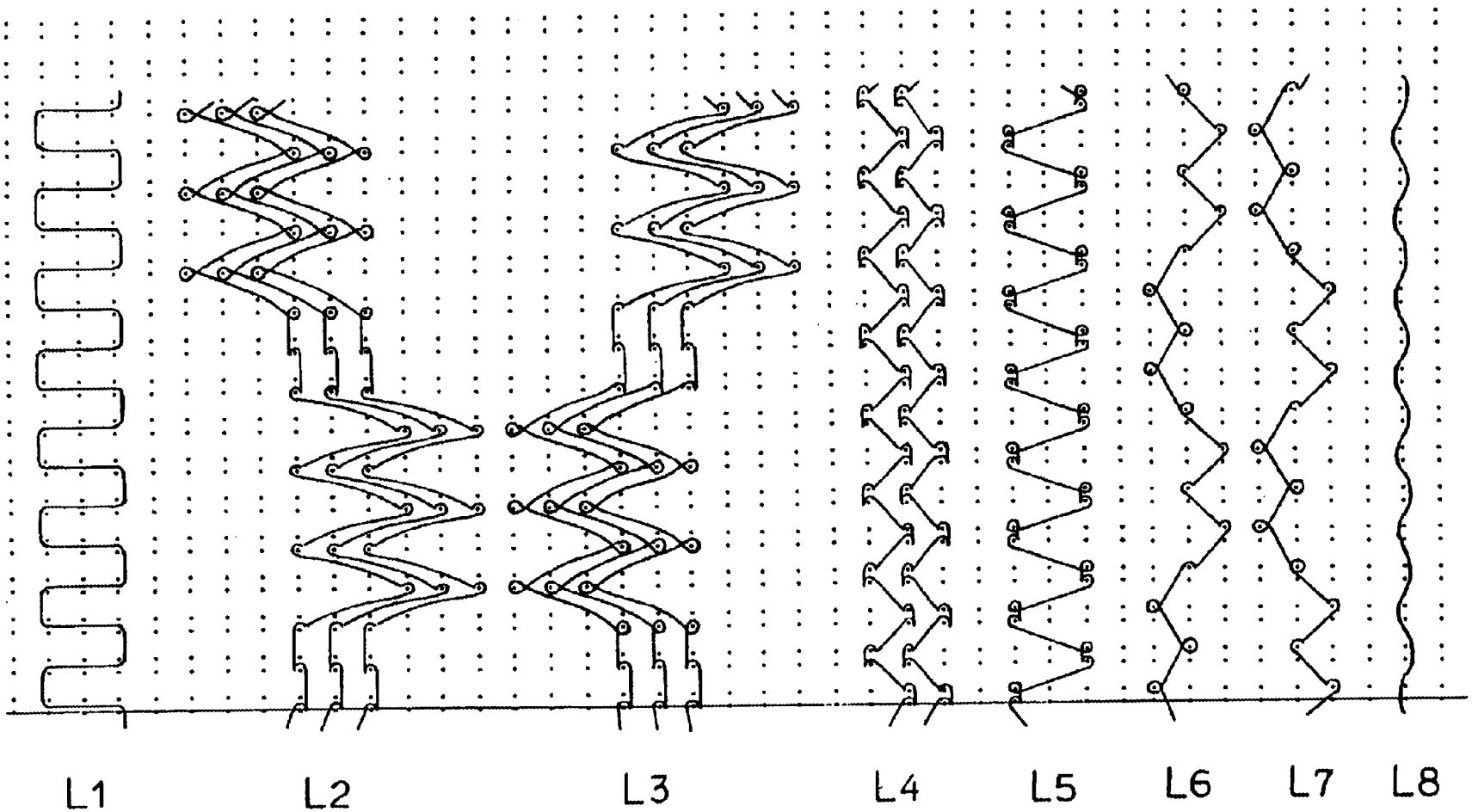
FIG. 18 is a lapping diagram of constituent yarns, showing an example of the knitting construction of the above net.

A three-dimensional net A of FIG. 17 is knitted, for example, with a knitting construction shown in FIG. 18, wherein the chain stitch guide bars L2 and L3 and the inlay yarn guide bar L1 are used for the front side while the chain stitch guide bars L6 and L7 and the inlay yarn guide bar L8 are used for the back side. Knitting is effected in the same manner as by L2, L3, L1, and L6, L7, L8 in the knitting construction of FIG. 13. As for the connecting yarns 3, first connecting yarn guide bar L4 guides two connecting yarns to traverse-wise pass through three successive wales while second connecting yarn guide bar L5 guides a single connecting yarn to traverse-wise pass through the three successive wales. The first connecting yarn guide bar L4 shifts connecting-yarns-passing wales to a rightward adjacent wales and a leftward adjacent wales on the second mesh web in alternate manner. Meanwhile, the second connecting yarn guide bar L5 shifts a connecting-yarns-passing wale by two wale to the wale that is transversely spaced two wales apart, on the second mesh web, in a rightward and leftward alternate manner.

In addition, in the knitting construction shown in FIG. 13, 16 or 18, the inlay yarn guide bar L1 on the front side may guide two inlay yarns every group of three successive wales for insertion through two wales by traverse motion, so that the braids 11 of this mesh web 1 are somewhat thickened and the construction is further stabilized. In this case also, the connecting yarns may be caused to cross each other in substantially X-form in larger mesh openings 12, making the three-dimensional net further stabilized.

Further, in each of the knitting constructions shown in FIGS. 6, 9, 13, 16 and 18, knitting may be effected by increasing the tension on inlay yarns to be guided by the inlay yarn guide bar L7 or L8 for the back side and inserting said inlay yarns substantially linearly in the knitting direction, thereby controlling the elongation of the braids 11 and 12 and further enhancing the shape stability.

Figure 19:
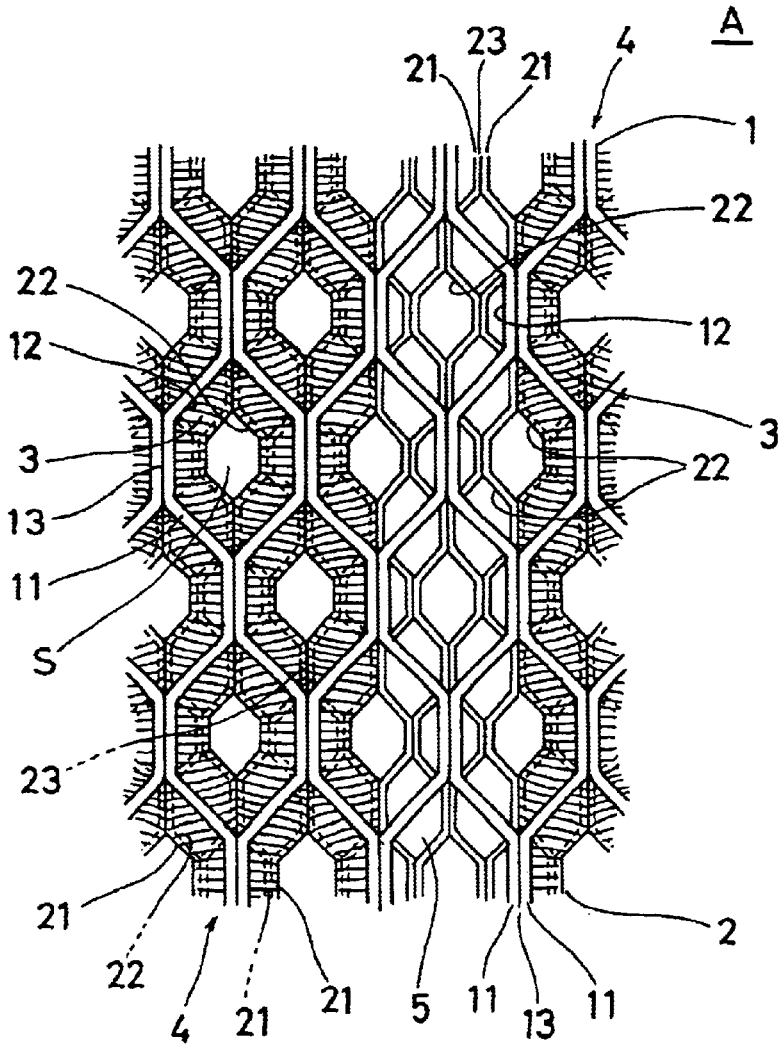
FIG. 19 is a fragmentary schematic plan view, showing a net according to still another embodiment of the invention.
Figure 20:
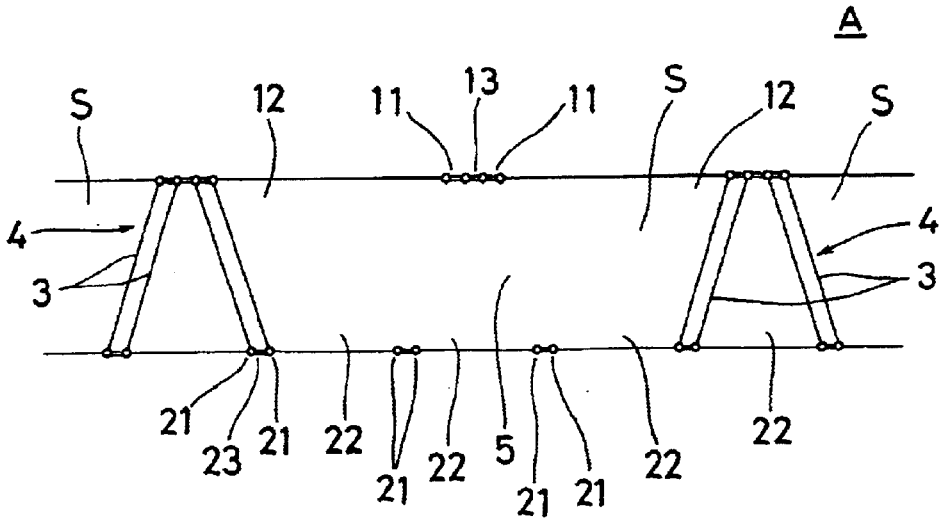
FIG. 20 is a fragmentary schematic enlarged sectional view of the above net.

In each of the above embodiments, as shown in FIGS. 19 and 20, knitting may be effected by omitting the connecting yarns 3 for the three-dimensional cords 4 at any positions, whereby devoid portions 5 devoid of connecting yarn 3 can be formed in the knitting direction between the first and second webs.

In the knitting Construction of FIG. 6 for example, certain connecting yarns 3, among the connecting yarns guided by the connecting yarn guide bar L4, are omitted for certain wale positions corresponding to the devoid portions 5. In this way, devoid portions 5 continuous in the knitting direction and having no connecting yarns therein are formed between the front and back mesh webs 1 and 2, providing a three-dimensional net A shown in FIG. 19.

The positions of said devoid portions 5 devoid of connecting yarns may be set at one's discretion by selecting yarn omitting wale positions on the connecting yarn guide bar. For example, said positions may be located at given intervals in the knitting direction.

Figure 21:
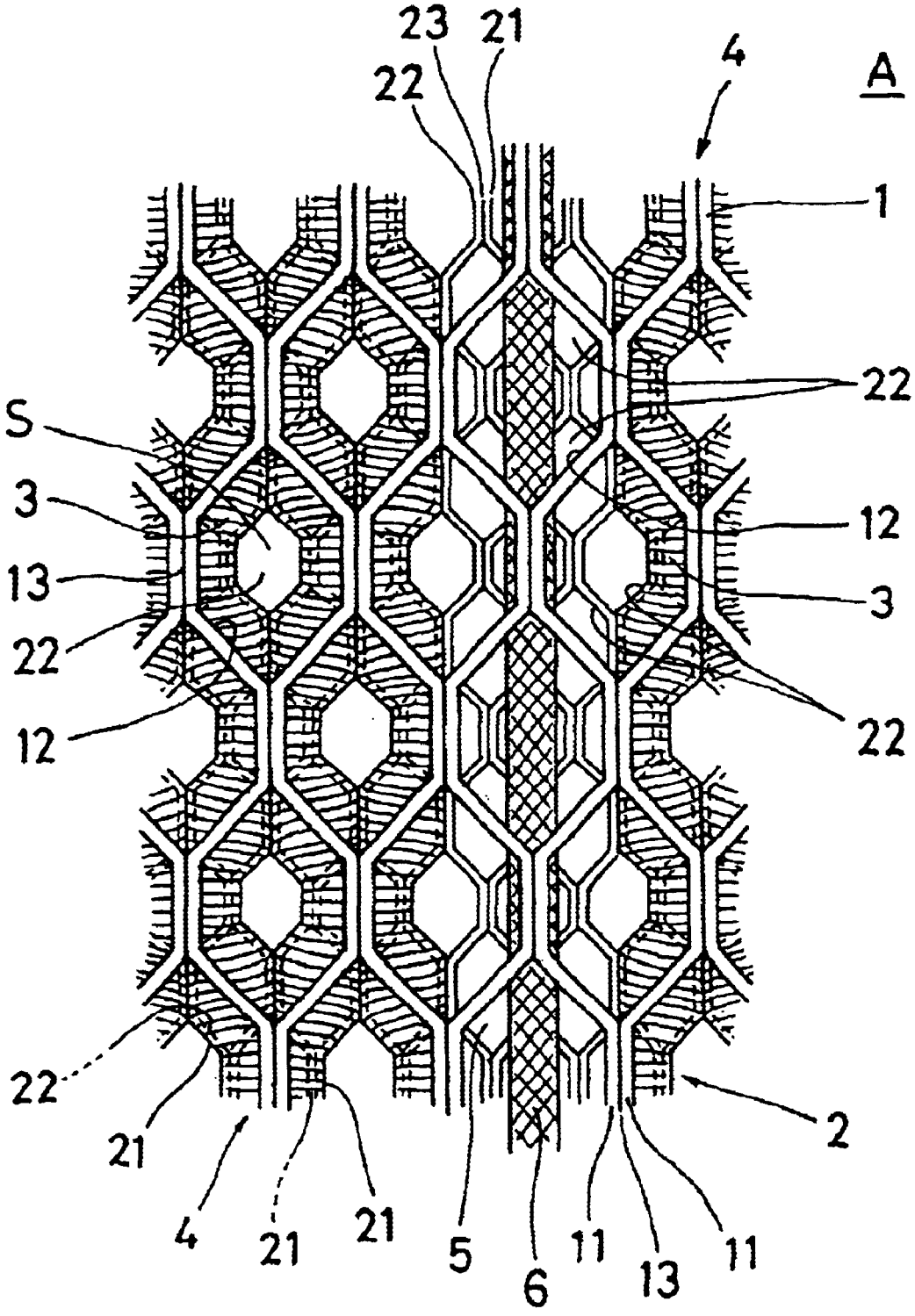
FIG. 21 is a fragmentary schematic sectional view, showing a net according to still another embodiment of the invention.

Since the devoid portions 5 devoid of connecting yarns continuous substantially linearly in the knitting direction, it is possible to insert, in the devoid portions 5, as shown in FIG. 21, various long objects 6 such as ropes or tapes for joining other members or stretching of the net, or wires or bar.

The long objects 6 to be inserted may be a non-woven fabric, cotton, polyurethane foam, various pipes, porous air pipe, cushion material, fiber thread, adhesive or sewing tape or rope or other ropes, elastic yarn or elastomer, a metal bar, a metal plate or the like, electricity or heat transfer body or heater, water-permeable net, fertilizer bag, vegetation base bag, water retaining material, material for preventing soil draw-out, antibacterial material, heat insulator, sound insulator, dust proof material, anti-electromagnetic wave material, anti-radiation material, seed belt, and seed bag. The three-dimensional net inserted with such long objects can be satisfactorily used as a composite material having functions suited for applications.

In addition, though not illustrated, at any positions in the knitting direction of the three-dimensional cords defining three-dimensional mesh spaces, devoid portions 5 devoid of connecting yarns may be formed between braids on the front and back sides so that when the net is deployed, said devoid portions 5 communicate with each other in the knitting-width direction. In this case also, as in the above, the long objects as described above may be inserted in the devoid portions 5 continuous in the knitting direction. Particularly, by simultaneously forming the devoid portions continuous in the knitting direction and the devoid portions continuous in the knitting-width direction, said long objects can be inserted crosswise.

Further, in the three-dimensional net A according to each of the embodiments described above, as shown in FIG. 22, a sleeve 7 continuous in the knitting-width direction omitting the connecting yarns 3 between the braids 11 and 21 of the front and back mesh webs 1 and 2 may be formed in a selvage of required width extending across a plurality of wales at either end in the knitting-width direction.

In the selvage, braids 11 and 21 are formed in a non-zigzag fashion, while the connecting yarns 3 are omitted in the central region of each of the selvage. In order to form the braids 11 and 21 on the selvage in the non-zigzag fashion, a heat-shrinkable yarn or elastic yarn are used as a constituent yarn for forming the mesh webs 1 and 2 at this selvage. Thereby, although no zigzag form is produced in the selvage, the braids 11 and 21 are bent in zigzags in the interior in the knitting-width direction to form mesh openings 13 and 23. An attachment member, connecting member or some other long object that is necessary in use may be inserted in or attached to the sleeve 7 in the selvage.

In the three-dimensional net A according to each of the embodiments described above, it is desirable from the standpoint of strength to constitute the braids 11 and 21 in the front and back mesh webs 1 and 2 by rows of stitches using chain stitch yarns and inlay yarns as shown in a knitting construction diagram in each embodiment.

Further, in the three-dimensional net A according to each of the embodiments, the shape of the polygon of the front and back mesh openings 12 and 22 and hence the shape and size of the openings of the three-dimensional mesh spaces S can be optionally set according to an increase or decrease in the junction length (the number of junction courses) of the junctions 13 or 23 in one or both of the front and back mesh webs 1 and 2 or the length (the number of courses) between junctions.

Particularly, a net may be obtained that differs in shape between the front and back mesh openings 12 and 22.

Further, the three-dimensional net A according to each of the embodiments described above may be knitted by varying the size and/or shape of the mesh openings 12 and 22 of the front and back mesh webs 1 and 2 in required places in the knitting direction. Particularly, in terms of construction, the mesh openings 12 and 22 of the front and back mesh webs 1 and 2 may reverse the size with each other.

Partly varying the size or shape of the mesh openings of the front and back mesh webs 1 and 2 in this manner makes it possible to vary the density or aesthetic design of the mesh openings of the front and back mesh webs and locally vary the elastic strength or pressure-resisting strength, so that a material suited for an application can be produced. This also improves balance with respect to the compressive load in the direction of the thickness, suppresses the direction dependency peculiar to double warp knitting, and further improves structural stability and pressure resistance. Further, the knitting density can be varied in any courses to vary the pressure-resisting strength. Further, knitting may be effected by varying the knitting gauges for the front and back mesh webs 1 and 2, whereby formation of larger and smaller mesh openings of the front and back mesh webs is facilitated.

In addition, though not illustrated, said three-dimensional net of the invention may be knitted such that the braids forming mesh openings in one of the front and back mesh webs, for example, the braids forming smaller mesh openings are knitted in marquisette construction using a row of stitches forming one wale of chain stitches and inlay yarns traverse-wise inserted in said row of stitches, thereby forming the mesh openings of said mesh web, for example, in a quadrangular shape to provide a varied net. In this case, the braids forming mesh openings in the other mesh web are knitted in the same construction as in the embodiment described above to form the mesh openings of said mesh web in a polygonal shape. And the connecting yarns connecting the two mesh webs on the front and back sides are extended from a single braid associated with the larger mesh openings to a plurality of braids associated with smaller mesh openings, thereby forming three-dimensional cords having the same three-dimensional voids as described above.

Forming one mesh web in a marquisette construction as described above results in a greater wale-wise and course-wise tensile strength and a superior wale-wise and course-wise dimensional stability and shape retainability, so that the net can be suitably used for applications where tensile strength is required.

In said three-dimensional net A, the constituent yarns for the front and back mesh webs 1 and 2, i.e., yarns, such as chain stitch yarns or inlay yarns, are not particularly restricted but suitably selected according to uses, and normally use is made of synthetic fiber yarns. Nylon yarns, carbon fiber yarns and other various synthetic fiber multifilament yarns and monofilament yarns or processed yarns, paralleled yarns and synthetic fiber spun yarns, and the like are suitably used. Of courser it is possible to use various natural fiber yarns and blended yarns.

Particularly, yarns having pliability, such as multifilament yarns or natural fiber yarns, may be used for the whole or part of at least one of the front and back mesh webs so as to make the surface soft. For example, if yarns having pliability are used as all or part of the constituent yarns for the mesh web 2 associated with the smaller mesh openings 22, the mesh web 2 becomes pliable, a fact which, together with the mesh openings 22 being smaller, results in the surface having a soft texture or a soft touch in spite of the fact that the three-dimensional net A has relatively large three-dimensional mesh spaces; therefore, the net can be suitably used as a material for cushions, a material for mate, a spacer for clothing, etc. Particularly, it can be used as such in its exposed state, Further, knitting may be effected such that in addition to the constituent yarns for said mesh web, pliable yarns are used as all or part of the connecting yarns, whereby said texture or touch of the front and back mesh webs 1 and 2 is further improved.

Further, knitting may be effected such that heat-shrinkable yarns or elastic yarns are used as all or part of the constituent yarns of at least one of the front and back mesh webs 1 and 2. In this case, the same heat-shrinkable yarns or elastic yarns as those described above may be used as all or part of the connecting yarns. Thereby, the net shrinks in the knitting direction to a suitable degree, and the stitches of the braids forming the mesh openings are tightened, further improving the shape retainability and stability. Particularly when elastic yarns are used, the elastic strength possessed by the elastic yarns and the restoring force that the connecting yarns have make it possible to improve the elastic recoverability of the net.

For example, in the knitting constructions shown in FIGS. 13 and 18, if heat-shrinkable yarns are used as the inlay yarns to be guided by the inlay yarn guide bar L8, the dimensional stability of the mesh openings increases and so does the shape stability of the three-dimensional structure itself.

Figure 22:
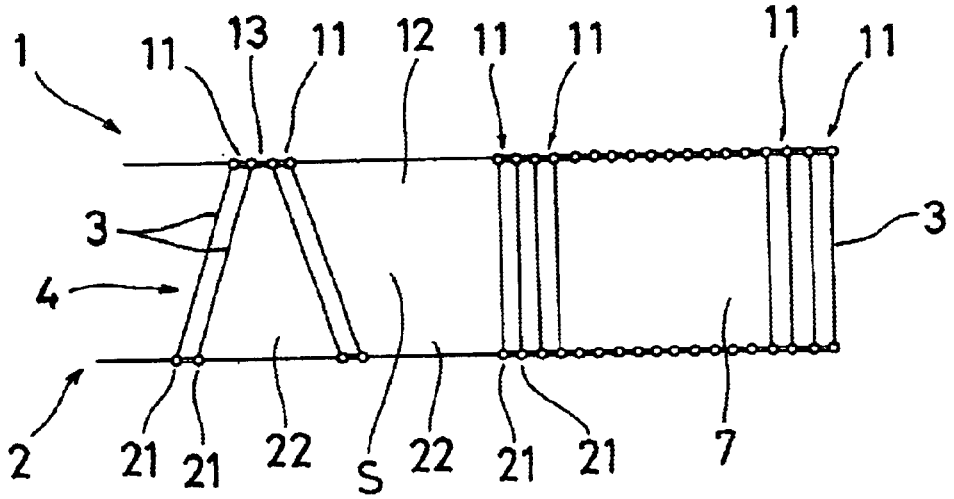
FIG. 22 is a fragmentary schematic sectional view, showing a net according to still another embodiment of the invention.
Figure 23:
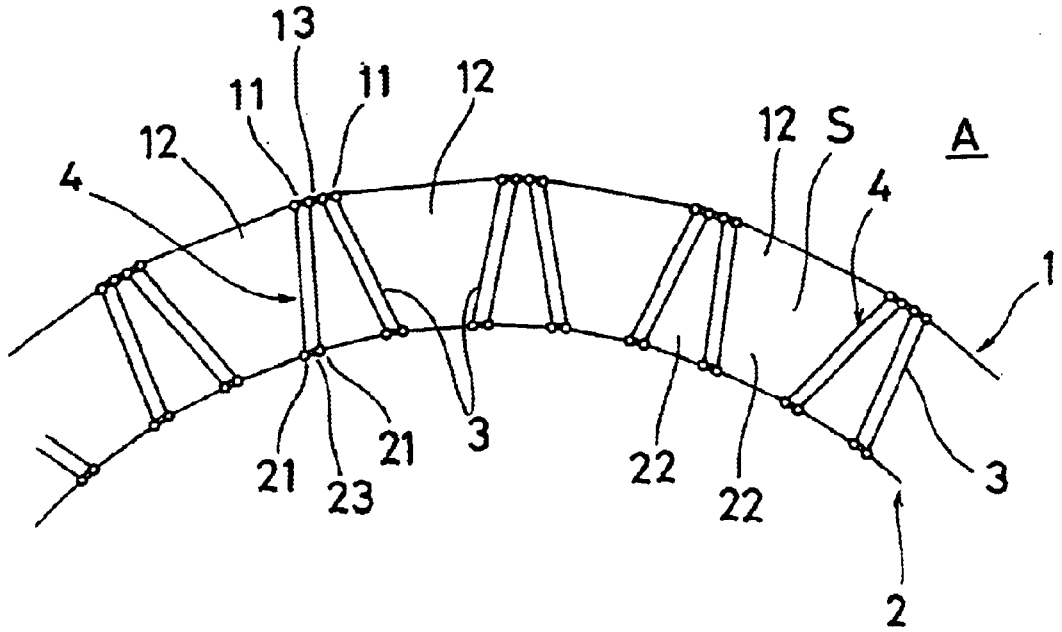
FIG. 23 is a fragmentary schematic sectional view, showing a net according to still another embodiment of the invention.

Further, knitting a three-dimensional structure of said knitting construction using heat-shrinkable yarns or elastic yarns for one of the mesh webs, e.g., the mesh web 2 results in said mesh web 2 shrinking as shown in FIG. 22, thus providing a three-dimensional net that is curved. The three-dimensional net formed in this manner, because of its curved form and elasticity, can be suitably used, for examples as an internal shock absorber for helmets or in a curved structural part.

Further, when a hollow three-dimensional net having stretchability is formed using elastic yarns, the mesh openings can be made smaller than in a net not using elastic yarns and fittability and elasticity that cannot be obtained in said net can be obtained, so that this net can be suitably used as a net for sport, clothing, medical use, or the like. Further, it is possible to provide a three-dimensional structure that has shape retainability and soft touch by changing the kind of yarns selected from the group consisting of elastic yarns, natural fiber yarns and synthetic fiber yarns every wale or every group of some successive wales.

Further, in knitting said three-dimensional net, various kinds of yarns dissimilar in rigidity, pliability or other properties, color, material, texture, dye or other processing effects may be used as the constituent yarns for the front and back mesh webs 1 and 2, whereby a net which differ in external appearance or properties between the front and back sides can be obtained.

Further, said connecting yarns 3 may be suitably selected, as in the case of the constituent yarns for the front and back mesh webs described above, from the group consisting of various synthetic fiber yarns, natural fiber yarns, blended fiber yarns, processed yarns and the like according to the use of the net in consideration of elasticity, pliability, strength, etc., so that they are suitable for connecting the front and back mesh webs 1 and 2 and supporting them in three-dimensional form, and in the case where pressure resistance is mainly required, monofilament yarns are suitable for use from the standpoint of retention of three-dimensional structure. In each case, besides being used in the form of single yarns, they may be in the form of a plurality of paralleled yarns. Further, it is also possible to use two or more kinds of yarns differing in properties, such as monofilament yarns and pliable yarns. For example, pliable yarns may be used for portions where sewing is required.

These yarns may be given a suitable degree of rigidity, anti-compressibility or elasticity by heat-setting or synthetic resin treatment or the like after knitting. Further, the greater the number and hence density of connecting yarns 3 connecting the front and back mesh webs 1 and 2, the greater the pressure-resisting strength and elastic force in the direction of the thickness. In the case of homogeneous material such as nylon, the thicker the yarns, the firmer to bending are the yarns.

The thickness and raw material of these yarns are determined in consideration of such factors as strength, tension, and elasticity that are required according to uses. For example, when a net for use as an industrial material, such as a material for cushions, material for mats, or cushion material for sheets for various vehicles, is to be knitted with 18-6 gauge (the number of needles/inch) on a double Raschel machine, yarns of 50–2000 deniers, preferably 100–1000 deniers, are suitably used for the mesh webs and yarns of 100–1000 deniers, preferably 100–3000 deniers, are suitably used as connecting yarns. For a vegetation net, yarns of 100–2000 deniers, preferably 200–600 deniers, are suitably used for the mesh webs and yarns of 100–3000 deniers, preferably 200–1500 deniers, are suitably used as connecting yarns.

However, when it is desired to knit or economically knit an elastic net, finer yarns than those mentioned above, for example, yarns of 22- to 16-gauge may be used. Further, when it is desired to increase physical strength, yarns of 4.5-3 gauge or yarns thicker than those mentioned above, may be used. Further, it is also possible to knit by using yarns that differ in thickness between the front and back sides, thereby further increasing the strength of the mesh webs, three-dimensional structural stability and cushioning function.

Further, as yarns and connecting yarns constituting said front and back mesh webs 1 and 2, it is possible to use yarns of decayable fibers, such as cotton, rayon, artificial silk and other natural fibers, degradable chemical fibers, such as enzyme-degradable fibers, which can be degraded by enzyme, and biodegradable fibers, which can be degraded by microorganisms or germs, or mixtures thereof with synthetic fibers. In this case, the three-dimensional net will decay or degrade due to secular use, so that it can be suitably used as a vegetation net or the like, and besides this, it can be used as a cushion material, strainer, tray for placing perishables, and other industrial materials. Further, waste disposal of the net after its use is facilitated, contributing to a solution of the problem of industrial waste.

Depending on the purpose of use of the three-dimensional net, it is possible to use water-absorbing yarns, such as yarns having a highly water-absorbing resin applied thereto as by coating or dipping, or yarns having fertilizer, iron or other metal, antibacterial agent, antifungal agent or other chemical agent, or fungi applied thereto by adhesion or kneading, so as to impart special functions to the yarns.

Further, after knitting of the three-dimensional net, metal may be deposited thereon by vapor metal deposition to use the net as one capable of absorbing electromagnetic waves or conducting electricity. Besides this, various functional material, such as active carbon and far infrared radiation materials, may be applied as by paste.

Further, a member selected from the group consisting of thermosetting fiber, heat-shrinkable fiber, thermoplastic fiber, a mixture containing such fibers, and paralleled yarns may be used for all or part of the yarns constituting the front and back mesh webs and of the connecting yarns, so that the stitch construction may be distorted or reinforced by heat treatment after knitting, so as to enhance the air or water retainability or shape stability of the net.

The thickness of the three-dimensional net A, and the size of the three-dimensional mesh spaces S or three-dimensional cords 4 depend on the application thereof, etc. For use as various cushion materials or mat materials, these nets are used in general with dimensions such that the net thickness is 2–100 mm, the diameter of the larger mesh openings 12 is 5–100 mm, and the diameter of the smaller mesh openings is 1–50 mm; for use as a vegetation net or the like, those nets are used in general with dimensions such that the net thickness is 3–150 mm, the diameter of the larger mesh openings 12 is 5–150 mm, and the diameter of the smaller mesh openings is 3–80 mm of course, an embodiment outside said dimensions is possible. For example, in the case of a spacer for clothing, etc., smaller dimensions than those mentioned above are possible. At any rate, it is preferable to set the void content of the net in relation to the thickness of the yarns so that it is 80% or above, more preferably 90% or above, whereby lightweight can be attained. Depending on uses, the void content may be lower than said value.

Figure 24:
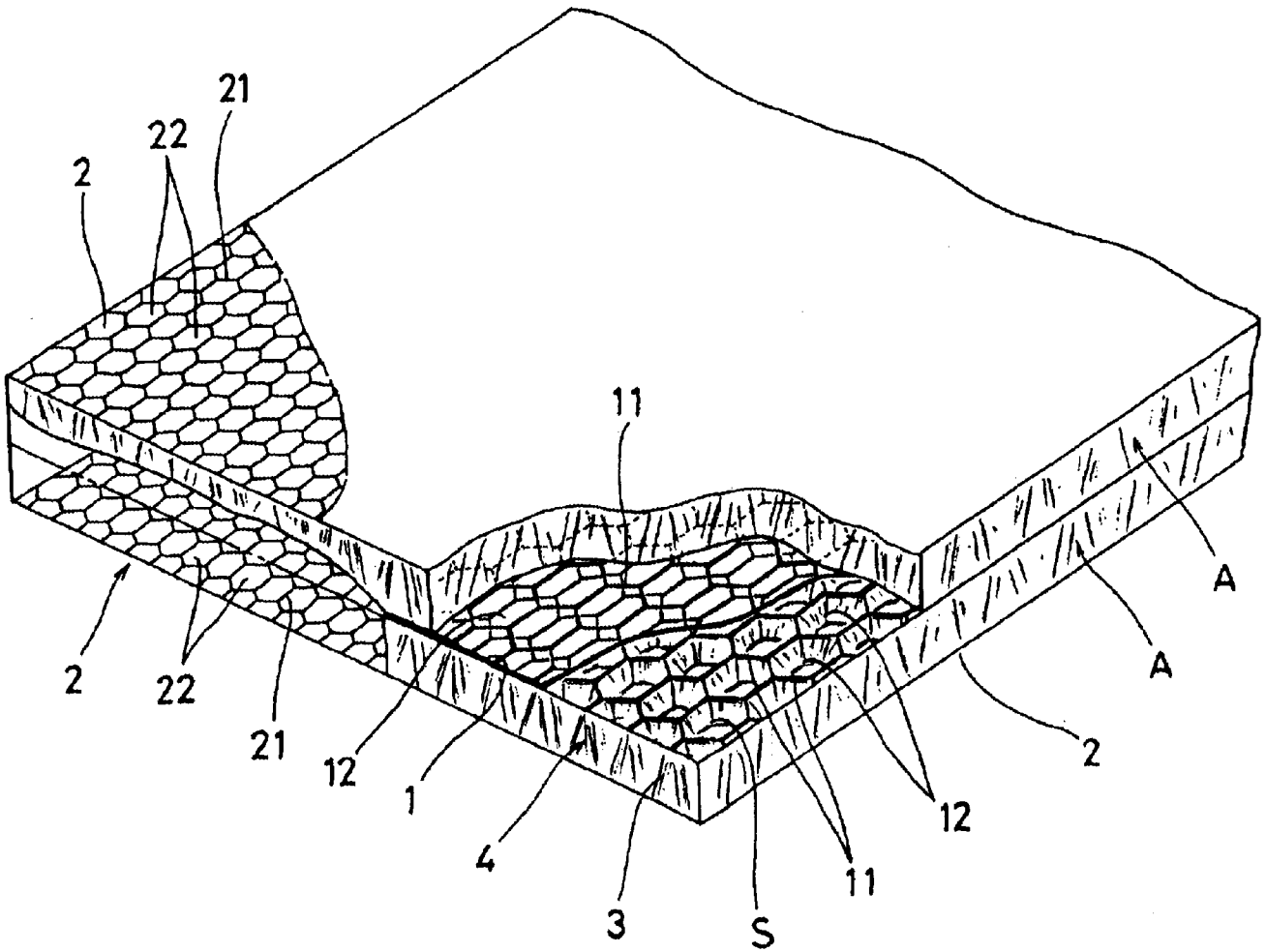
FIG. 24 is a schematic perspective view, partly broken away, showing a composite structural material according to an embodiment of the present invention.
Figure 25:
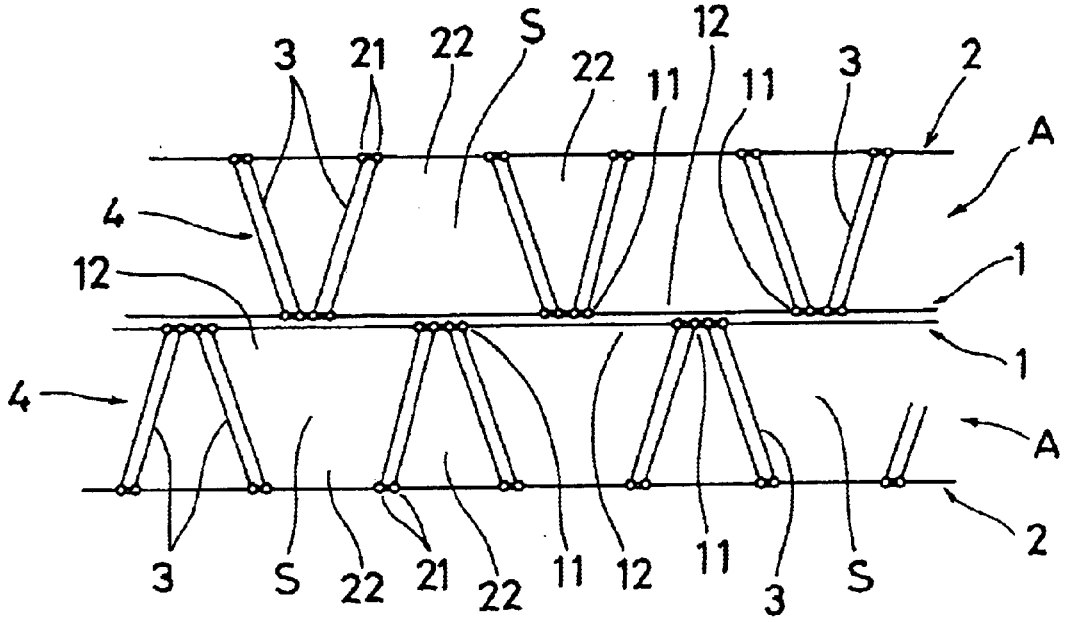
FIG. 25 is a fragmentary schematic sectional view of the above composite structural material.

Said three-dimensional net A is used singly for various applications by utilizing the structural characteristics described above. Besides this, a plurality of nets that are stacked may be used as a composite structural material. FIGS. 24 and 25 show an example thereof. In this embodiment, two three-dimensional nets A are stacked such that their mesh webs 11 associated with the larger mesh openings. 12 abut against each other. This stack of two nets A, has its opposed mesh webs bound for integration by binding means such as sewing or bonding as occasion arises.

In this composite structural material, the mutually abutting nets A, cooperate with each other to control their deformation and direction dependency that is peculiar to double-web knitted fabrics. Furthermore, the abutting portions of the mesh webs 1, 1 function as reinforcing layers, so that though the composite structural material is thick and high in void content, its shape retainability, structural stability and pressure resistance are satisfactorily retained. For this reason, with its aforesaid characteristics utilized, it can be suitably used for various applications in, for example, cores for beds, cushion materials for pillows, chairs and sofas, materials for various mats such as floor mats, swimming pool mats and bathroom mats, shock absorbers, materials for clothing, medical materials, filters, rucksacks, bags, insoles and cushion materials for shoes, other core materials and cushion materials, etc.

In addition, though not illustrated, they may be stacked such that their sides associated with the smaller mesh openings 22 or the larger mesh openings 12 and the smaller mesh openings 22, respectively, abut against each other. In the case where the mesh webs 1, 1 associated with the lager mesh openings 12 are put together, the smaller mesh openings 22 appear in both of the front and back sides and the entire void content is high while reducing the weight. In order to obtain strength and pressure resistance according to uses and to obtain a cushioning effect that generates no feeling of touching the bottom, such factors as the knitting gauge, yarn thickness and mesh size for a plurality of three-dimensional nets A to be stacked may be varied or elasticity may be varied.

Figure 26:
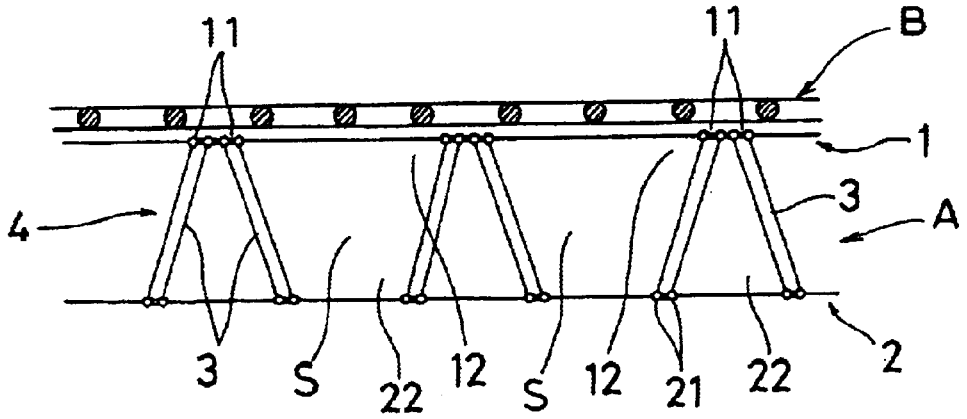
FIG. 26 is a fragmentary schematic sectional view, showing a composite structural material according to another embodiment of the present invention.

Further, according to uses, as shown by way of example in FIG. 26, a composite structural material may be formed that comprises a stack of said three-dimensional net A and another net body B of planar or three-dimensional construction, and if necessary, said net A and net body v may be bound together by binding means such as sewing or laminating. Thereby, the shape retainability and structural stability of the three-dimensional net A are enhanced and the composite structural material can be suitably used in various applications in which the void retainability and elasticity provided by three-dimensional construction are utilized.

Figure 27:
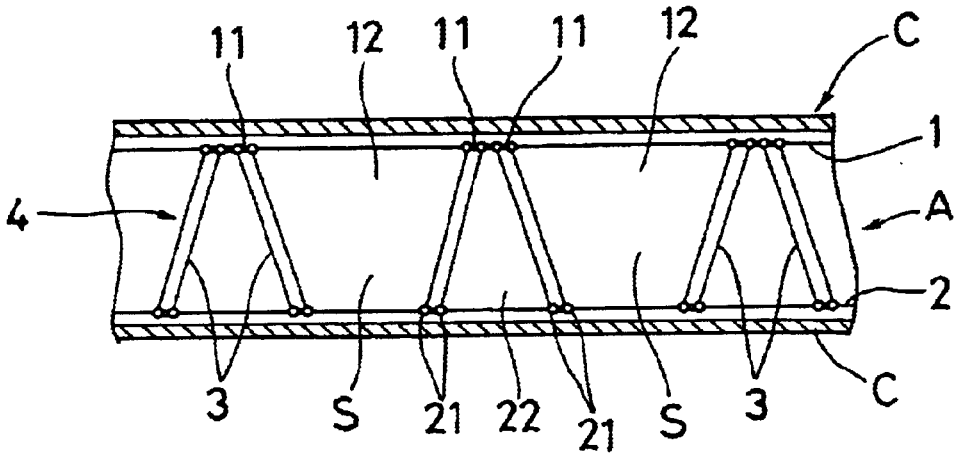
FIG. 27 is a fragmentary schematic sectional view, showing a composite structural material according to still another embodiment of the present invention.

Further, as shown in FIG. 27, a composite structural material including a three-dimensional net A may have on at least one of its front and back sides and/or intermediate region, for example, on its front and back surfaces, as shown, a sheet C, such as knit or woven fabric, pile fabric, nonwoven fabric, synthetic resin film, or paper, placed thereon and joined thereto as by sewing or laminating. The peripheral edges of the sheets C may be closed to enclose the whole of the three-dimensional net, etc. Said sheet C is not limited in use to a single three-dimensional net but applicable to the composite structural materials shown in FIGS. 24 and 26, in which said sheet C may be placed on at least one of the front and back sides and/or an intermediate one of a plurality of nets.

In this case also, the pressure resistance and structural stability of said three-dimensional net A can be satisfactorily retained and the net can be suitably used as a mat material, cushion material, etc. by making use of the characteristics of the net and sheet. Particularly, suitable selection of the elasticity of the net provides an effect that generates no feeling of touching the bottom. Further, if a composite structural material is prepared such that a three-dimensional net made by using a strong yarn of aramid fiber or the like is used as a mesh web on which a sheet made of said synthetic resin or the like is stacked, then strength and durability can be increased.

In addition, though not illustrated, a sheet article made of synthetic resin, wood, metal, ceramic material, cement or the like may be stacked on and joined to a three-dimensional net A to provide a composite structural material high in shape stability, which composite structural material can be suitably used particularly as a wall material for structures, insulator, etc.

Figure 28:
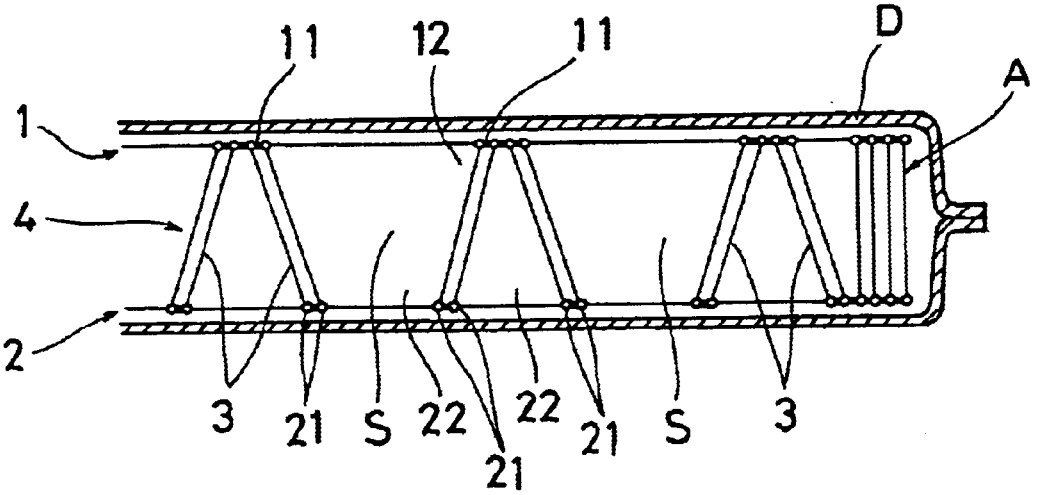
FIG. 28 is a fragmentary schematic sectional view, showing a composite structural material according to still another embodiment of the present invention.

Further, as shown in FIG. 28, a composite structural material including a three-dimensional net A may be adhesively covered with a gas-impermeable sheet D, such as a synthetic resin film, and have gas, liquid, powder or a mixture thereof enclosed therein. Further, instead of said gas-impermeable sheet, a gas-permeable sheet may be used to coat a three-dimensional net A and a solid substance, such as particles, may be filled therein.

Thereby, the elastic strength and pressure resistance possessed by the three-dimensional net A are coupled with the deformability of the enclosed or internally filled substance to make the three-dimensional net A suitable for use for bedding, such as beds and pillows, furniture, such as chairs and sofas, car interior materials, such as sheets and covers, etc.

A mat or cushion containing air, water, oil or other liquid, for example, an air mat or water mat, may be stacked on a three-dimensional net A to provide a composite structural material. In this case, a cushion material making use of their individual inherent cushioning properties may be obtained. Further, although an airbed and a waterbed would be poor in gas permeability, the same when made in the form of a composite structure as described above will have satisfactory gas-permeability and cushioning property. These also can be suitably used as an interior material for bedding, such as beds and pillows, furniture, such as chairs and sofas, car interior materials, such as sheets and covers, etc.

Figure 29:
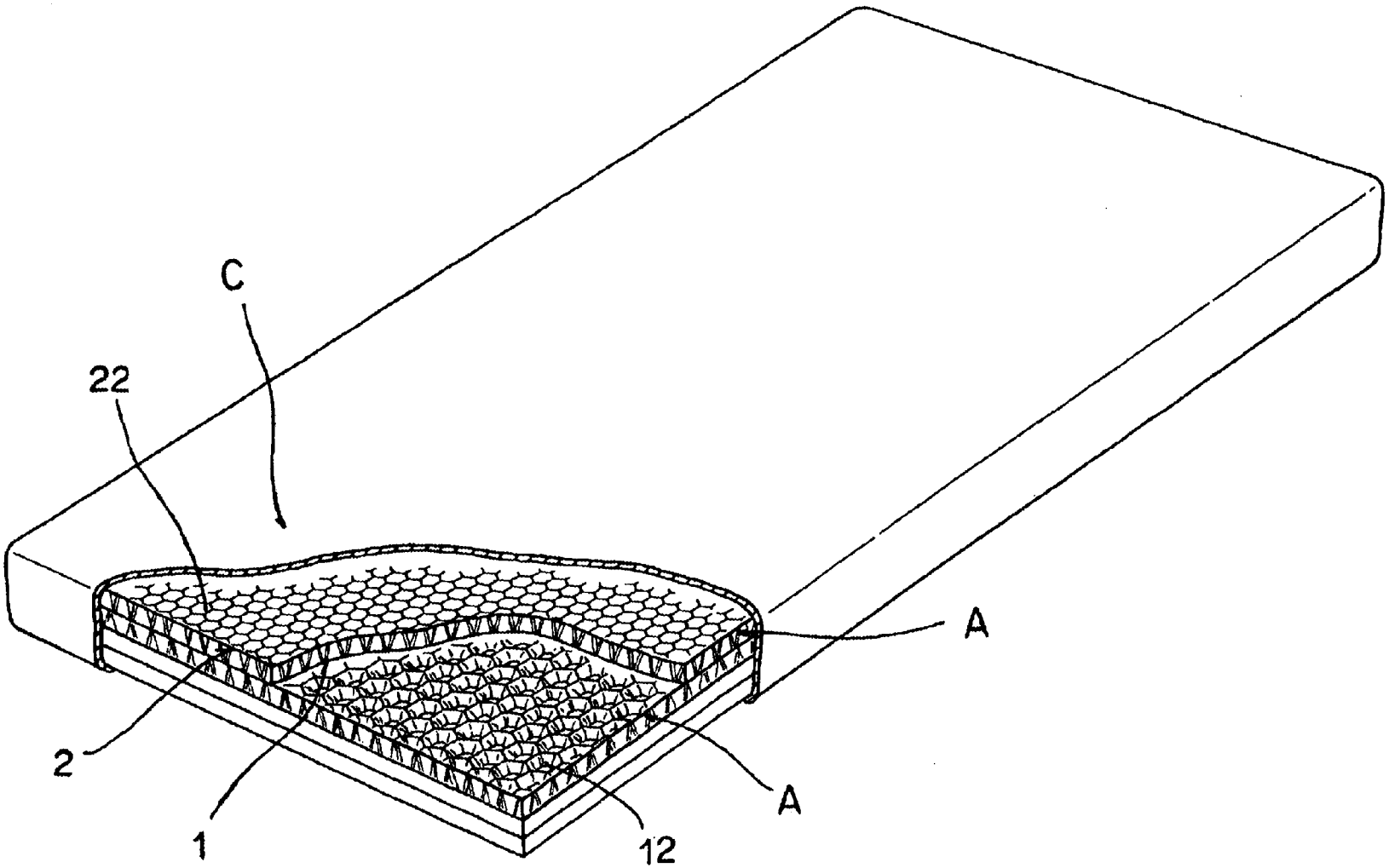
FIG. 29 is a perspective view, partly broken away, showing an example in which a three-dimensional net according to the invention used as a mattress for bedding.
Figure 30:
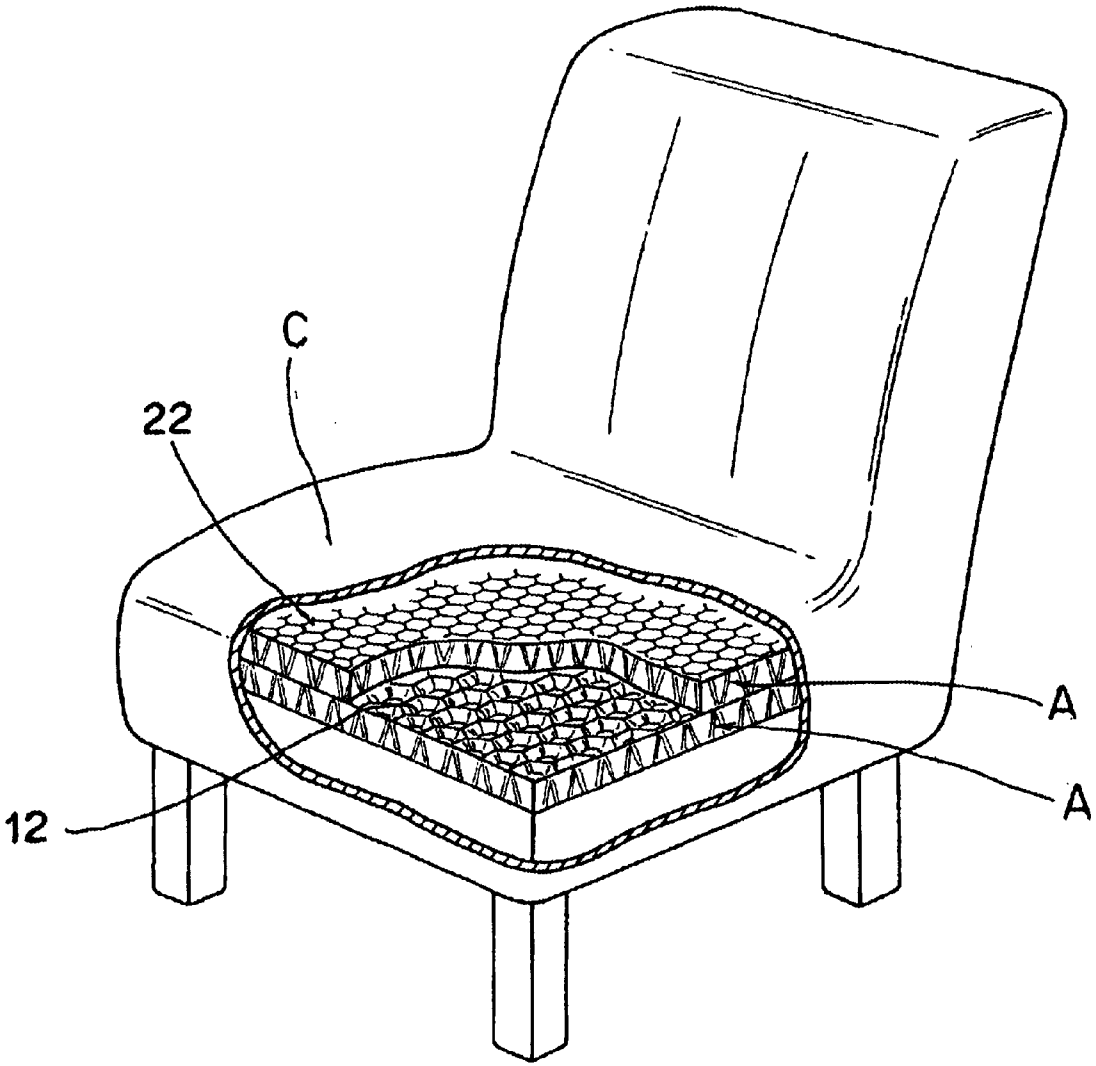
FIG. 30 is a perspective view, partly broken away, showing an example in which a three-dimensional net according to the invention used as a material for chair cushions.
Figure 31:
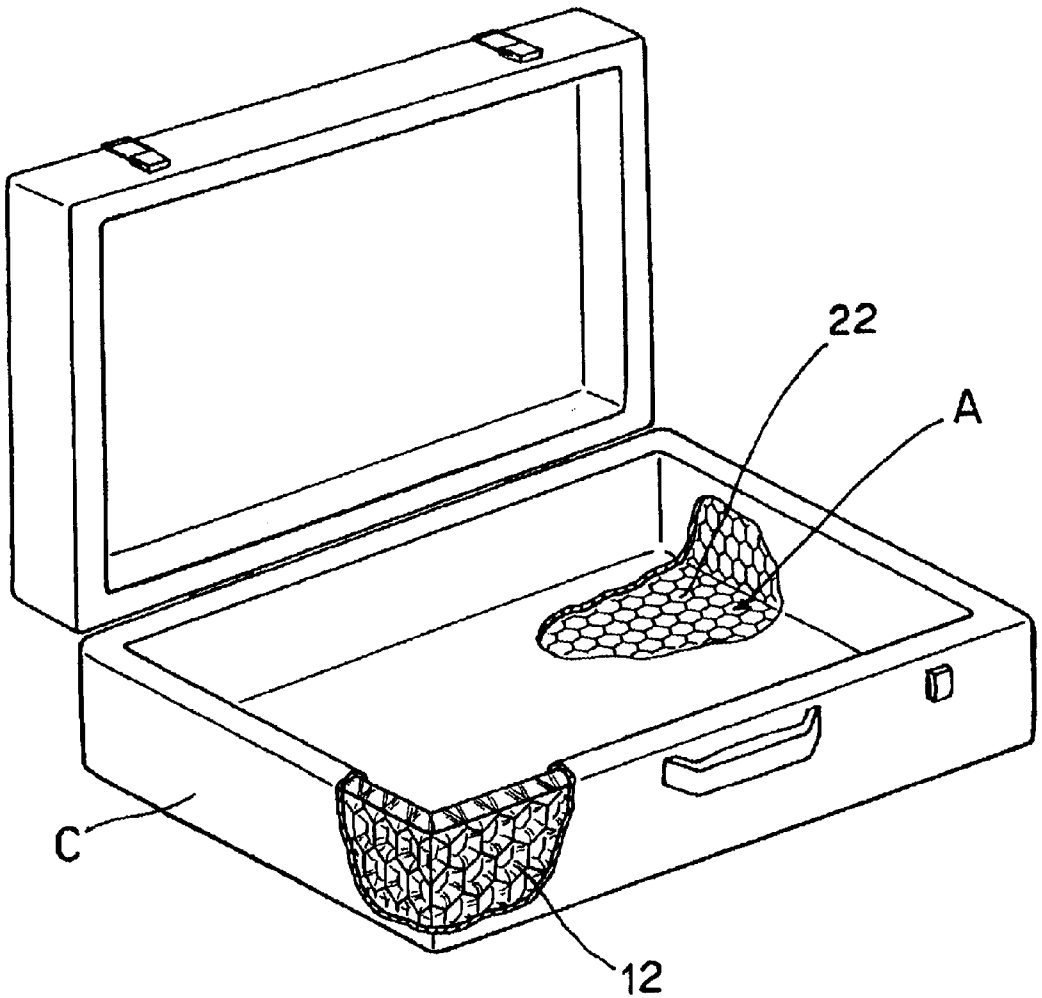
FIG. 31 is a perspective view, partly broken away, showing an example in which a three-dimensional net according to the invention used as a bag.

FIG. 29 shows an example in which a plurality of three-dimensional nets A are stacked and the stack is covered with a sheet C, such as a knitted or woven fabric, the article being used for a bed-mattress, and FIG. 30 shows an example in which it is likewise used for a chair. FIG. 31 shows an example in which a three-dimensional net A according to the invention is used for a bag.

Particularly, though omitted from illustration, where the three-dimensional mesh spaces are relatively small, the net, with its side associated with the smaller mesh openings being exposed, can be used as an article that also serves as an exterior.

Industrial Applicability

As described above, the three-dimensional net A of the present invention has its mesh openings made different in size between the front and back mesh webs and has relatively large three-dimensional mesh spaces, wherein the side associated with the smaller mesh openings is nice to the touch, the net having an improved appearance, satisfactory shape retainability for the three-dimensional cords defining the three-dimensional mesh spaces, the capability of removing the direction dependency peculiar to warp knitting, and superior structural stability, pressure resistance and elasticity. Further, simply applying tension results in forming the three-dimensional cords defining the three-dimensional mesh spaces, the net, as a whole, having a high void content and being light in weight and superior in gas permeability because of the three-dimensional shape having three-dimensional voids in the three-dimensional cords. Further, constructing this three-dimensional net in the form of a composite structural material makes it possible to further enhance the structural stability while retaining satisfactory pressure resistance, elasticity and gas permeability, even if the net is thick and high in void content.

Therefore, the three-dimensional net and composite structural material of the present invention can, by making use of their characteristics, be widely suitably used in all industrial fields, as core materials and cushion materials for beds and other bedding articles, mat materials, carpet materials, cushion materials for furniture, such as chairs, sheets and interior materials for cars, interior materials and structural materials for aircrafts, or their intermediate materials, substrates and cover materials, cushion materials and packaging materials for transport, various other industrial materials, such as spacers and the like for clothing, protective nets for medical purposes, vegetation nets and protective nets used for maintenance of the faces of slopes and greening work for greening purposes, protective nets and vegetation nets for bank protection, water collection and discharge nets for developed lands or the like, protective nets for industrial waste disposal plants, safety nets for construction work, protective nets for building work, concrete-reinforcing nets, nets for making reinforcing materials or structures used in blowing mortar, synthetic resin or the like, and snowing or icing nets also serving for protection of the gliding surfaces of skis, snowboards, ice skates, etc.

What is claimed is:

1. A three-dimensional net formed by warp knitting and having a first mesh web, a second mesh web and connecting yarns connecting the first and second mesh webs, on front and back sides of the net, with a required spacing therebetween;

each of said mesh webs being formed such that mesh openings are defined by ribbons continuous in a knitting direction, each of said ribbons being alternately junctioned together with a rightward adjacent ribbon and a leftward adjacent ribbon at a required interval in the knitting direction as to define respective polygonal mesh openings on each of said mesh webs;

a number of said ribbons on the second mesh web being larger than that on the first mesh web and thereby, a size of the mesh openings on the first mesh web being smaller than that on the second mesh web, said connecting yarns being front-back-wise passed between the ribbons defining relatively small and large mesh openings, so as to form three-dimensional cords;

said three-dimensional cords being formed such that the connecting yarns are front-back-wise passed from each of the ribbons defining relatively large mesh openings on the second mesh web, to a plurality of the ribbons defining relatively small mesh openings on the first mesh web, thereby forming a three-dimensional void within each of said three-dimensional cords shaped such that width thereof on the second mesh web encompasses the relatively small mesh openings and such that said connecting yarns are inclined as front-back-wise passed between the first and second webs, at least partly among portions for defining three-dimensional mesh spaces.

2. A three-dimensional net as set forth in claim 1, wherein said three-dimensional void forms a tunnel structure continuous in at least one of the knitting direction and in the knitting-width direction, as substantially being communicated between two ends.

3. A three-dimensional net as set forth in claim 1, wherein:

the ribbons defining the relatively large mesh openings in the first mesh web are formed by at least one row of stitches forming at least one wale, while the ribbons defining the relatively small mesh openings in the second mesh web are formed by a row of stitches forming one wale or by rows of stitches forming less wales than in the ribbons defining the relatively large mesh openings.

4. A three-dimensional net as set forth in any one of claims 1, 2 and 3, wherein:

in the knitting direction, a number of knitting courses for one or more mesh openings in the first mesh web is equal to a multiple of a number of knitting courses for one smaller mesh opening in the second mesh web;

while in the knitting direction and in the knitting-width direction, a size of one or more mesh openings on the first mesh web is equivalent to a size of a plurality of smaller mesh openings on the second mesh web.

5. A three-dimensional net as set forth in any one of claims 1, 2 and 3, wherein:

in a plan view, at least one mesh opening on the second mesh web falls substantially in a middle portion of a larger mesh opening on the first mesh web, and connecting yarns are front-to-back-wise passed between the ribbons respectively defining said at least one mesh opening and said larger mesh opening in such a manner as to surround entire peripheries of said at least one mesh opening, so that the three-dimensional mesh spaces defined therein are substantially funnel-shaped.

6. A three-dimensional net as set forth in any one of claims 1, 2 and 3, wherein, in a plan view, junctions of ribbons on the second mesh web fall substantially on junctions of braids and middle portions of mesh openings on the first mesh web, said three-dimensional net further comprising:

vertical connecting yarns each passed between a junction on the first mesh web and a coincided junction on the second mesh web; and inclined connecting yarns each passed between a junction on the first mesh web and rightward and leftward adjacent junctions on the second mesh web, each of said adjacent junctions falling substantially in a middle portion of a larger mesh opening on the first mesh web in a plan view.

7. A three-dimensional net as set forth in any one of claims 1, 2 and 3, wherein, at discretionary positions in the knitting direction in the three-dimensional cords, each of the connecting yarns are passed from a first row of stitch on the first mesh web to a second row of stitch, on the second mesh web, said second row of stitch being shifted rightward or leftward by at least one wale from a row of stitch coincided with the first row of stitch, thereby connecting yarns crossing each other in substantially X-form in the three-dimensional cords or three-dimensional mesh spaces.

8. A three-dimensional net as set forth in any one of claims 1, 2 and 3, wherein, at required places in the knitting direction, at least one of the size and shape of the mesh openings on the first and second mesh webs is varied.

9. A three-dimensional net as set forth in any one of claims 1, 2 and 3, wherein devoid portions devoid of the connecting yarns between front and back braids are formed in at least one of selected positions in a knitting direction at each of the three-dimensional cords and at at least another selected position of the three-dimensional cords arranged in a knitting-width direction.

10. A three-dimensional net as set forth in any one of claims 1, 2 and 3, wherein, in selvages on both ends in a knitting-width direction, at least one of the connecting yarns is omitted so as to form a sleeve continuous in the knitting direction.

11. A composite structural material made by stacking a plurality of three-dimensional nets recited in any one of claims 1, 2 and 3.

12. A composite structural material as set forth in any one of claims 1, 2 and 3, wherein a plurality of three-dimensional nets different in knitting gauge, yarn thickness and mesh opening size are stacked.

13. A composite structural material made by stacking a three-dimensional net recited in any one of claims 1, 2 and 3 and a net of another construction.

14. A composite structural material including a three-dimensional net recited in any one of claims 1, 2 and 3, further comprising:

a flat stuff selected from a group consisting of a knit fabric, a woven fabric, a pile fabric, a nonwoven fabric, a sheet of cottony fluff material, a sheet of urethane foam, a synthetic resin film, a paper, a synthetic resin plate, a wood plate, a metal plate, and a mat-shaped cushion stuff containing air, water or oil therein; and said flat stuff being placed in a position at least one of on and between the three-dimensional nets, said flat stuff being adhered to at least one of the front and back sides of the three-dimensional net.

15. A composite structural material including a three dimensional net recited in any one of claims 1, 3 and 4, further comprising:

sheets having a desired degree of gas permeability being stuck on the front and back sides of the three-dimensional net to cover the latter; and at least one selected from a group consisting of gas, liquid, powder, a mixture thereof, and solid particles, which is enclosed or filled within the three-dimensional net.

* * * * *